US011313336B2

(12) United States Patent
Miyake et al.

(10) Patent No.: US 11,313,336 B2
(45) Date of Patent: Apr. 26, 2022

(54) COMPONENT FOR FLOW RATE CONTROL DEVICE, AND FUEL INJECTION VALVE

(71) Applicant: Hitachi Automotive Systems, Ltd., Hitachinaka (JP)

(72) Inventors: Takao Miyake, Hitachinaka (JP); Yasuo Namaizawa, Hitachinaka (JP); Takumasa Furuyama, Hitachinaka (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 0 days.

(21) Appl. No.: 17/046,847

(22) PCT Filed: Feb. 13, 2019

(86) PCT No.: PCT/JP2019/004955
§ 371 (c)(1),
(2) Date: Oct. 12, 2020

(87) PCT Pub. No.: WO2019/202829
PCT Pub. Date: Oct. 24, 2019

(65) Prior Publication Data

US 2021/0040926 A1 Feb. 11, 2021

(30) Foreign Application Priority Data

Apr. 20, 2018 (JP) ..... JP2018-081472

(51) Int. Cl.
*F02M 51/06* (2006.01)
*F02M 63/00* (2006.01)
(Continued)

(52) U.S. Cl.
CPC ..... *F02M 51/061* (2013.01); *F02M 51/0607* (2013.01); *F02M 51/0628* (2013.01);
(Continued)

(58) Field of Classification Search
CPC ..... F02M 51/061; F02M 51/0685; F02M 2200/8084; F02M 2200/8061;
(Continued)

(56) References Cited

U.S. PATENT DOCUMENTS 5,775,600 A 7/1998 Wildeson
2008/0035761 A1* 2/2008 Akabane ..... F02M 51/0682 239/585.1
(Continued)

FOREIGN PATENT DOCUMENTS

JP H11-193762 A 7/1999
JP 2000-515947 A 11/2000
(Continued)

OTHER PUBLICATIONS

International Search Report with English translation and Written Opinion issued in corresponding application No. PCT/JP2019/004955 dated Jun. 11, 2019.

*Primary Examiner* — Yi-Kai Wang
(74) *Attorney, Agent, or Firm* — Foley & Lardner LLP

(57) ABSTRACT

An object of the present invention is to provide a fluid control device with an improved effect of suppressing blow-hole generation. Therefore, a component for a flow rate control device of the present invention includes: a first component 140 (A); a second component 107 (B) fixed to the first component by a press-fitting portion 802; a butt-welded portion 803 connecting the first component and the second component; and a first gap 1001 and a second gap 1002 formed between mutually opposing surfaces of the first component and the second component. The first gap is provided on a side of the press-fitting portion with respect to the second gap between the press-fitting portion and the butt-welded portion, and is formed in a direction intersecting a press-fitting direction. The second gap is provided on a side of the butt-welded portion with respect to the first gap
(Continued)

between the press-fitting portion and the welded portion, and is formed in a direction intersecting the first gap.

9 Claims, 16 Drawing Sheets

(51) Int. Cl.
*F02M 61/18* (2006.01)
*F02M 57/02* (2006.01)

(52) U.S. Cl.
CPC .... *F02M 51/0653* (2013.01); *F02M 51/0675* (2013.01); *F02M 61/1873* (2013.01); *F02M 63/0017* (2013.01); *F02M 57/026* (2013.01); *F02M 2200/80* (2013.01); *F02M 2200/8061* (2013.01)

(58) Field of Classification Search
CPC ..... F02M 61/168; F02M 2200/80; F02M 57/026; F02M 63/0017; F02M 61/1873
USPC ..... 239/585.5
See application file for complete search history.

(56) References Cited

U.S. PATENT DOCUMENTS

| | | | | |
|---|---|---|---|---|
| 2009/0108107 | A1 | 4/2009 | Kitagawa | |
| 2011/0204276 | A1* | 8/2011 | Huemmer | F02M 61/168 251/366 |
| 2014/0367498 | A1* | 12/2014 | Takaoku | F02M 51/061 239/584 |
| 2019/0040827 | A1 | 2/2019 | Miyake | |

FOREIGN PATENT DOCUMENTS

| | | | |
|---|---|---|---|
| JP | 2009-108758 | A | 5/2009 |
| JP | 2013-160083 | A | 8/2013 |
| WO | WO-2017/168975 | A1 | 10/2017 |

* cited by examiner

COMPONENT FOR FLOW RATE CONTROL DEVICE, AND FUEL INJECTION VALVE

TECHNICAL FIELD

The present invention relates to a flow rate control device that controls a flow rate.

BACKGROUND ART

Examples of the related art for flow rate control devices are an electromagnetic fuel injection valve device described in JP H11-193762 A (PTL 1) and an electromagnetic fuel injection valve described in JP 2013-160083 A (PTL 2).

In the electromagnetic fuel injection valve device of PTL 1, a movable valve is formed of an electromagnetic core and a movable needle having different material compositions, and both the members are welded and joined. In the movable valve, an end surface of the electromagnetic core and the movable needle are butt-welded to each other, and a melted portion is formed such that a weld penetration depth is larger than a length of a butt surface (see, for example, claims 1 and 2 and FIG. 2).

The fuel injection valve of PTL 2 is the electromagnetic fuel injection valve including: a nozzle tube having an injection hole for ejecting fuel at a distal end; a fixed core that is press-fitted into an inner peripheral portion of the nozzle tube and has an outer peripheral portion forming a fitting portion with the inner peripheral portion; a movable core that is arranged in the nozzle tube, faces the fixed core, and is capable of reciprocating in the nozzle tube; a valve body that is driven by the movable core to open and close the injection hole; and an electromagnetic coil that is arranged on the outer circumference of the nozzle tube and electromagnetically drives the movable core. An annular non-fitting portion (annular gap) is formed in a part of the fitting portion, and the nozzle tube and the fixed core are welded and joined at this non-fitting portion to eliminate a welding defect caused by evaporation of a lubricant (see Abstract, claim 1, and FIGS. 4 and 9). The annular gap mitigates the vapor pressure by its volume and contributes to suppression of generation of the welding defect (see paragraph 0053). In the fuel injection valve of PTL 2, the lubricant is applied to the inner peripheral portion of the nozzle tube, and the lubricant is scraped off at the fitting portion at the time of press fitting to prevent the lubricant from entering the annular gap (see paragraph 0055).

CITATION LIST

Patent Literature

PTL 1: JP H11-193762 A
PTL 2: JP 2013-160083 A

SUMMARY OF INVENTION

Technical Problem

The electromagnetic fuel injection valve device of PTL 1 and the electromagnetic fuel injection valve of PTL 2 are examples of a flow rate control device. Hereinafter, the electromagnetic fuel injection valve device of PTL 1 and the electromagnetic fuel injection valve of PTL 2 will be simply referred to as the fuel injection valve for description.

In PTL 1, it is considered to improve durability by making the weld penetration depth larger than the length of the butt surface of a butt-welded portion, but there is no consideration regarding generation of a blowhole due to vaporization of the lubricant during welding caused by adhesion or entry of the lubricant to a planned weld portion.

In the fuel injection valve of PTL 2, it is considered to suppress the lubricant from entering the annular gap where the welded portion is provided, but the fitting portion to which the lubricant adheres comes into contact with the inner peripheral surface of the nozzle tube where the welded portion is provided, and no configuration capable of supporting butt welding is provided.

Two components to be butt-welded are press-fitted and fixed before welding. A lubricant is applied to areas to be press-fit before press fitting, but the lubricant is vaporized during welding and a blowhole is generated as described in PTL 2 if the lubricant adheres to or enters the planned weld portion.

In the fuel injection valve of PTL 2, it is considered to suppress the lubricant from entering the annular gap where the welded portion is provided, but the fitting portion to which the lubricant adheres comes into contact with the inner peripheral surface of the nozzle tube where the welded portion is provided, and there is a demand for a technique of further improving the effect of suppressing the blowhole generation.

An object of the present invention is to provide a component of a fluid control device with an improved effect of suppressing blowhole generation.

Solution to Problem

In order to achieve the above object, the present invention provides a flow rate control device including: a first component; a second component fitted with the first component by a press-fitting portion; an abutting surface that comes into contact with one surface of the first component and an opposing surface of the second component therebetween; and a welded portion formed along the abutting surface on the abutting surface of the first component and the second component. A first gap is formed by the first component and the second component among a press-fitting fitting portion between the first component and the second component, an abutment, and a welded portion. A second gap is formed by the first component and the second component among the first gap, the abutment, the welded portion. The first gap is formed in a direction intersecting a press-fitting direction, the second gap is formed in a direction intersecting the abutment direction, and the first gap is larger than the second gap.

Advantageous Effects of Invention

According to the present invention, it is possible to provide the fluid control device with the improved effect of suppressing the blowhole generation. Other objects, configurations, and effects which have not been described above become apparent from embodiments to be described hereinafter.

DESCRIPTION OF EMBODIMENTS

Figure 1A:
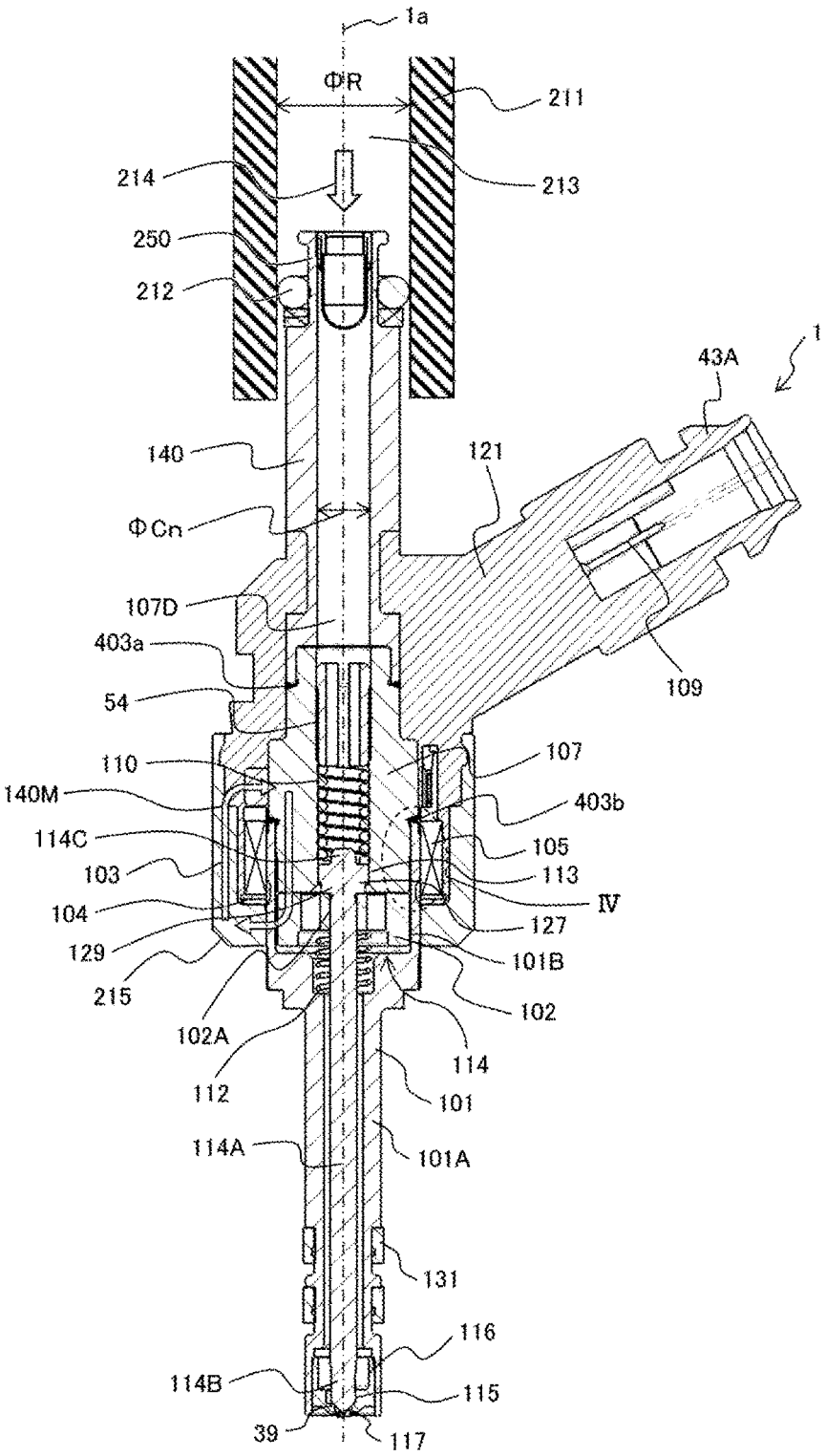
FIG. 1A is a cross-sectional view partially illustrating a fuel injection valve 1 and a fuel pipe 211 according to an embodiment of the present invention.

Hereinafter, specific modes for carrying out the present invention will be described with reference to the drawings.

Hereinafter, an embodiment of a flow rate control device of the present invention will be described with reference to the drawings. In the present embodiment, a fuel injection valve (fuel injection device) will be described as an example of the flow rate control device, but the present invention is not limited thereto. For example, the flow rate control device may be a high-pressure fuel pump in which large stress is generated in a welded portion due to high fuel pressure. Note that, in the drawings, a size of a component or a size of a gap is sometimes exaggerated as compared with its actual ratio in order to facilitate understanding of a function, and an unnecessary component is sometimes omitted in order to describe the function. In the embodiment and comparative examples to be described below, the same reference signs are given to constituent elements of the same type. In the embodiment and comparative examples according to the present invention, different points will be mainly described, and the redundant description will be omitted.

First, an outline of a configuration of the fuel injection valve according to the present embodiment will be described with reference to FIG. 1. FIG. 1A is a cross-sectional view partially illustrating a fuel injection valve 1 and a fuel pipe 211 according to the present embodiment.

In the following description, an up-and-down direction is defined and described based on FIG. 1A, but this up-and-down direction does not limit an up=and-down direction in a mounting state of the fuel injection valve 1. The fuel injection valve 1 is provided with a fuel supply port 118 at an upper end portion and a fuel injection hole 117 at a lower end portion. There is a case where a side where the fuel supply port 118 is provided is referred to as a proximal end, and a side where the fuel injection hole 117 is provided is referred to as a distal end for description.

As illustrated in FIG. 1, in the fuel injection valve 1, for example, a mover portion 114 includes a cylindrical movable core (mover) 102 and a needle valve 114A (valve body) located at the center of the movable core 102. A gap is provided between an end surface of a fixed core (stator) 107 having a fuel introduction hole for guiding fuel to the center and an end surface of the movable core 102. An electromagnetic coil 105 (solenoid) that supplies a magnetic flux is provided in a magnetic path including the gap. In other words, the fixed core 107 is arranged so as to oppose the movable core 102 as illustrated in FIG. 1.

The movable core 102 is attracted toward the fixed core 107 to drive the movable core 102 by a magnetic attraction force generated between the end surface of the movable core 102 and the end surface of the fixed core 107 due to the magnetic flux passing through the gap, and the needle valve 114A is separated from a valve seat portion 39 (valve seat) to open a fuel passage provided in the valve seat portion 39. In other words, the movable core 102 drives the needle valve 114A (valve body).

The amount of injected fuel is mainly determined depending on a pressure difference between a fuel pressure and an atmospheric pressure at an injection opening of the fuel injection valve 1 and a time for which fuel is injected with the needle valve 114A kept open.

When the energization of the electromagnetic coil 105 is stopped, the magnetic attraction force acting on the movable core 102 disappears, the needle valve 114A and the movable core 102 move in a closing direction due to a biasing force of an elastic member 110 that biases the needle valve 114A in the closing direction and a pressure drop caused by the flow velocity of fuel flowing between the needle valve 114A and the valve seat portion 39. When the needle valve 114A is seated on the valve seat portion 39, the fuel passage is closed. The fuel is sealed by the contact between the needle valve 114A and the valve seat portion 39 so that the fuel is prevented from leaking from the fuel injection valve 1 at an unintended timing.

In an internal combustion engine, attempts have been made to increase the injection pressure of fuel from the conventional 20 MPa to, for example, about 35 MPa, reduce a droplet size of the fuel injected from a fuel injection valve, and promote vaporization.

When the fuel pressure is increased, stress generated in a member (fuel pressure holding member) that holds the fuel pressure inside the fuel injection valve increases. In order to allow the fuel pressure holding member to have a margin of strength against the stress generated at the high fuel pressure, it is advantageous to select a material having high yield stress and tensile strength.

Meanwhile, since the fixed core 107 of the fuel injection valve 1 forms a part of the electromagnetic solenoid, a material having excellent magnetic characteristics is used. In general, the material having excellent magnetic characteristics has low yield stress and tensile strength. Therefore, the material used for the fixed core 107 is unsuitable for use in a connecting portion with the fuel pipe 211, which requires a small thickness and high rigidity.

Accordingly, in the fuel injection valve 1 supporting the high fuel pressure, the connecting portion with the fuel pipe 211 is configured using the adapter 140 which is a separate component from the fixed core 107, and is divided into two components, that is, the fixed core 107 and the adapter 140. The fuel supply port 118 is formed at an end portion of the adapter 140 on a side opposite to the fixed core 107 side. The adapter 140 is made of a material having higher yield stress and tensile strength than the fixed core 107, and the fixed core 107 is made of a material having excellent magnetic characteristics. The two components are press-fitted in a valve axis direction (direction along the central axis 1*a*), and then, welded over the entire circumference at 403*a* and fixed.

Therefore, the fuel injection valve that ensures the strength against an increase in fuel pressure without causing deterioration of the magnetic characteristics of the fixed core 107 can be manufactured while an increase in cost is suppressed.

For the same reason, the fixed core 107 and the injection hole cup support body (nozzle holder) 101 are divided into two components, a material having higher yield stress and tensile strength than the fixed core 107 is used for the injection hole cup support body 101, and a material having excellent magnetic characteristics is used for the fixed core 107. The two components are press-fitted in the direction of the central axis 1*a* so as to be pressed against each other in the radial direction, and then, welded over the entire circumference at 403*b* and fixed.

In the upper part of FIG. 1A, a load acting in the direction of the central axis 1*a* of the fuel injection valve 1 due to the fuel pressure is schematically illustrated by an arrow 214. Since the fuel injection valve 1 is connected to the fuel pipe 211 and the fuel is sealed by an O-ring 212, an inside 213 of the fuel pipe 211 and an inside of the fuel injection valve 1 are filled with high-pressure fuel. A cross-sectional area of the fuel pipe 211 is determined by an inner diameter φR of the fuel pipe 211, and the product of the cross-sectional area of the fuel pipe 211 and the fuel pressure is defined as a fuel pressure load.

Since the fuel pipe 211 is fixed to an engine (not illustrated), the fuel injection valve 1 receives the fuel pressure load in a direction of the arrow 214. Since the fuel injection valve 1 is in contact with the engine (not illustrated) at a tapered surface 215 of a housing 103, for example, the above-described fuel pressure load is transmitted through the adapter 140, the fixed core 107, the injection hole cup support body 101, and the housing 103 that constitute the fuel injection valve 1.

Figure 1B:
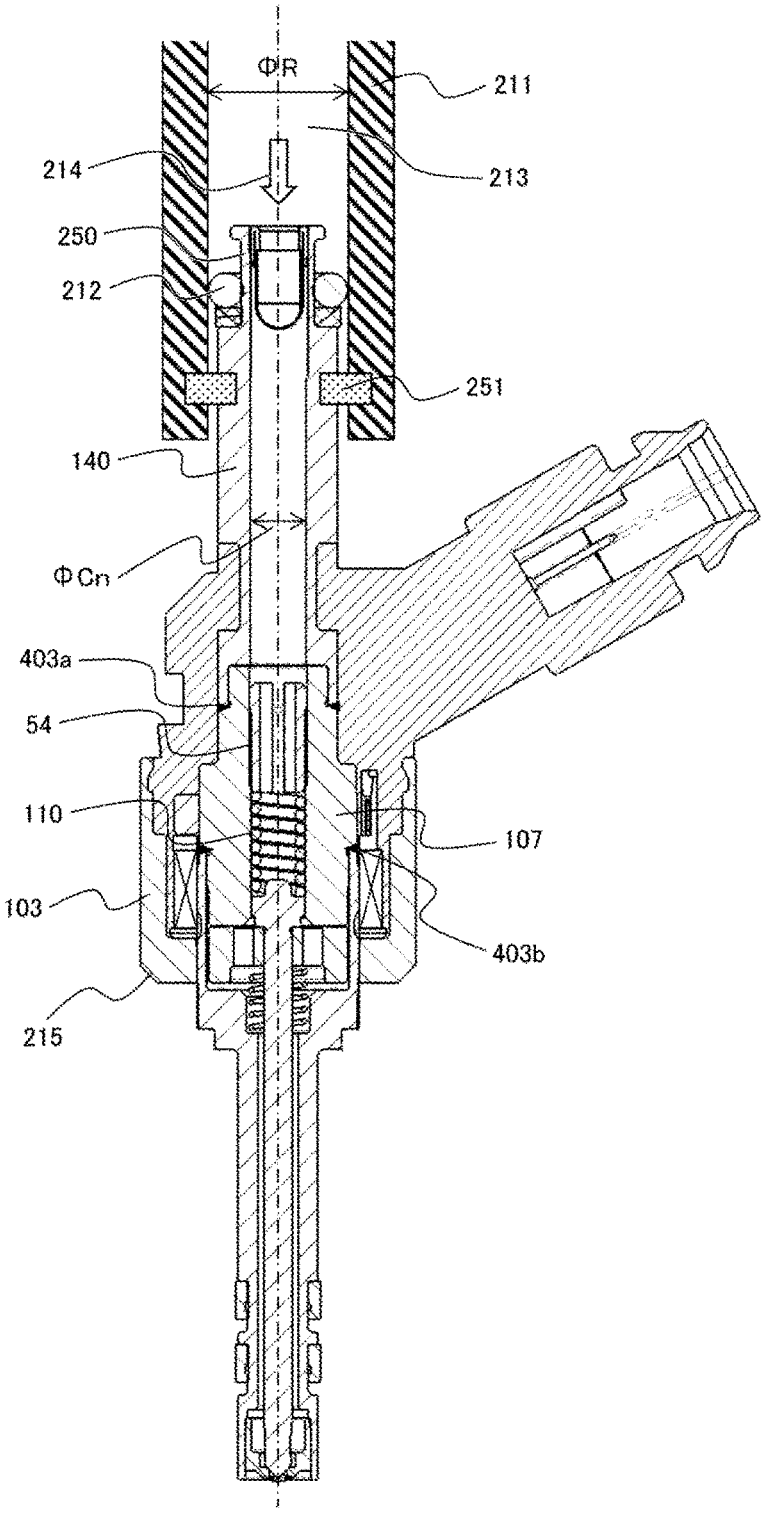
FIG. 1B is a cross-sectional view illustrating a connection structure different from that of FIG. 1A regarding a connection structure between the fuel injection valve 1 and the fuel pipe 211 according to the embodiment of the present invention.

FIG. 1B is a cross-sectional view illustrating a connection structure different from that of FIG. 1A regarding a connection structure between the fuel injection valve 1 and the fuel pipe 211 according to the embodiment of the present invention.

In the fuel injection valve 1 illustrated in FIG. 1B, a mode in which the fuel injection valve 1 can be suspended from the fuel pipe 211 via a plate 251 is illustrated as a mode different from the connection structure between the fuel injection valve 1 and the fuel pipe 211 illustrated in FIG. 1A.

Figure 2:
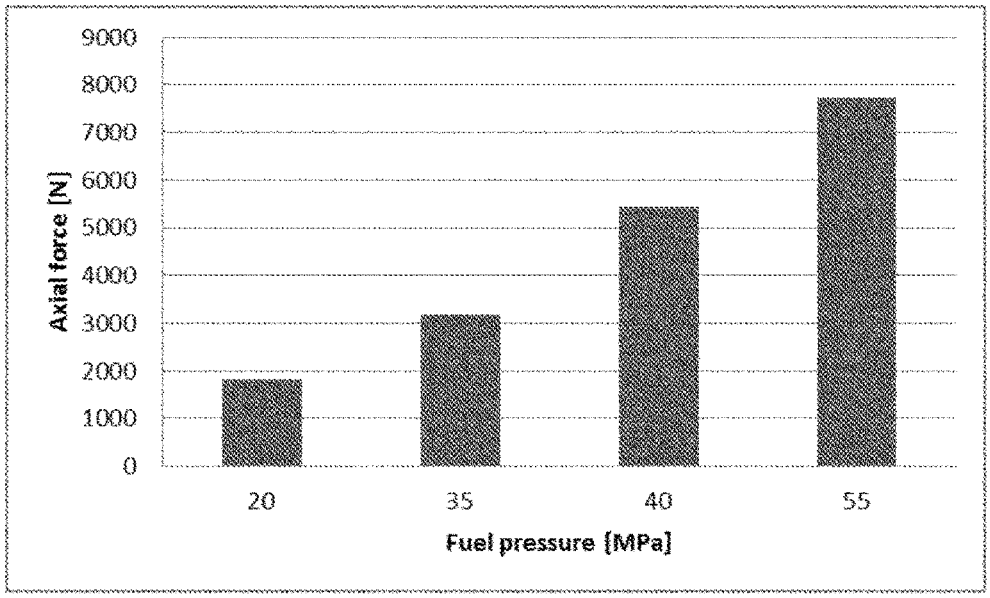
FIG. 2 is a graph illustrating the relationship between a fuel pressure inside the fuel injection valve and a load (calculated value) applied in a direction of the central axis 1*a* of the fuel injection valve 1.

FIG. 2 is a graph illustrating the relationship between a fuel pressure inside the fuel injection valve and a load (calculated value) applied in the direction of the central axis 1*a* of the fuel injection valve 1.

Figure 3:
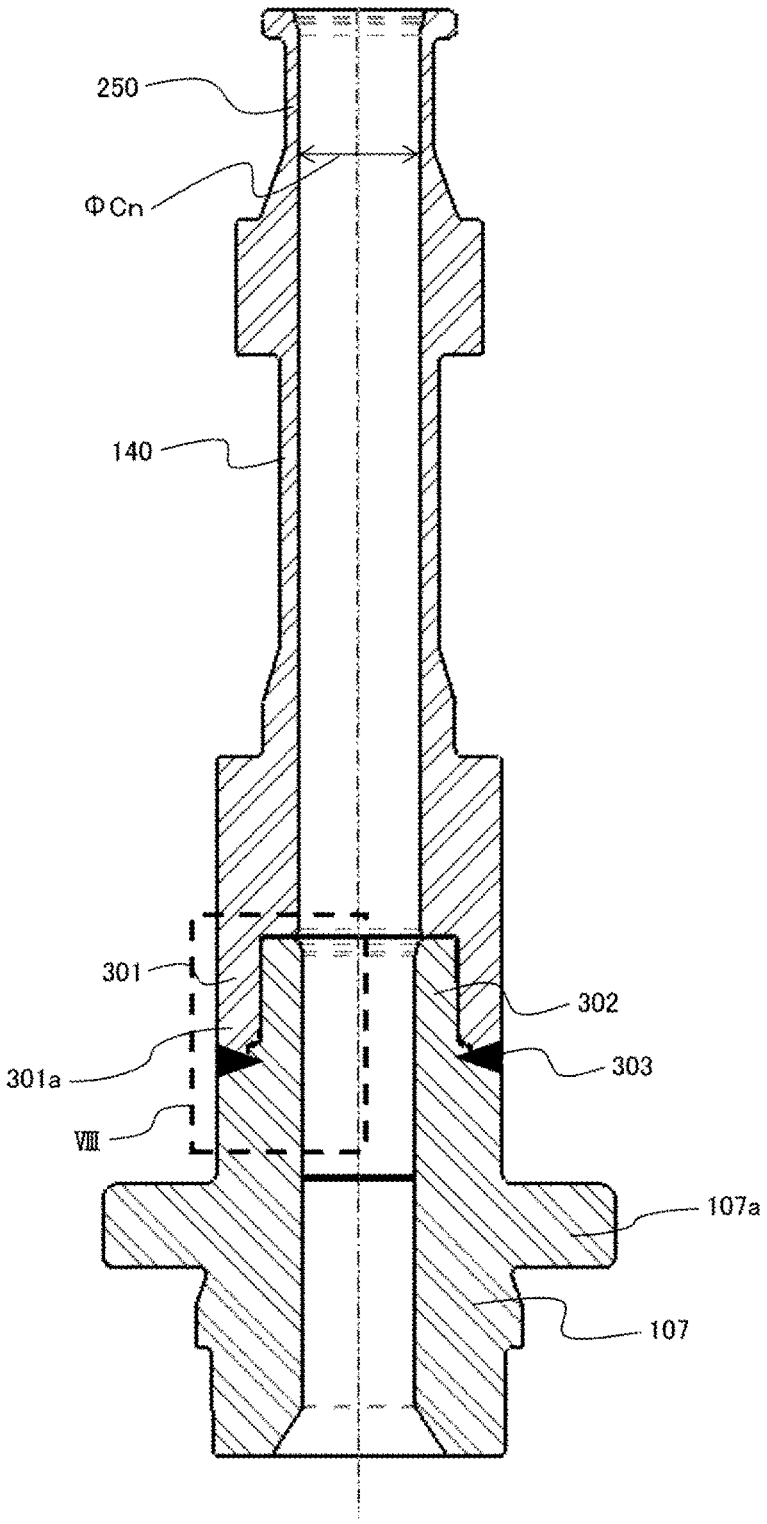
FIG. 3 is a cross-sectional view illustrating an assembly of an adapter 140 and a fixed core 107 that form the fuel injection valve 1.

Conventionally, a maximum fuel pressure is, for example, 20 MPa, and a load (axial load) applied in the direction of the central axis 1*a* of the fuel injection valve 1 by the fuel pressure of 20 MPa is, for example, 1800 N. The fuel pressure is likely to be further increased to 35 MPa, an axial load in such a case becomes approximately 3200 N, which is 1.5 times of the former. Further, in a system assuming the fuel pressure of 35 MPa, for example, it is necessary to maintain the structural strength up to a fuel pressure of 55 MPa in consideration of a safety margin, and an axial load in such a case reaches approximately 7700 N. Since the axial load depending on the fuel pressure is transmitted to components forming the fuel injection valve 1, stress generated in each component increases as the fuel pressure increases. If shapes, materials, and weld shapes of the components forming the fuel injection valve 1 are not changed from the conventional components, the margin of strength decreases. On the other hand, the use of a material having high strength or a complicated welding method leads to an increase in cost. FIG. 3 is a cross-sectional view illustrating an assembly of the adapter 140 and the fixed core 107 that form the fuel injection valve 1.

Since the thickness of an O-ring mounting portion 250 of the adapter 140 is small, a material is selected with priority on strength. The adapter 140 can withstand the stress generated at the fuel pressure of 35 MPa. The fixed core 107 is a component constituting a magnetic circuit, and does not have a thin portion like the O-ring mounting portion 250. Accordingly, a material having excellent magnetic characteristics is selected for the fixed core 107. The fixed core 107 has a large thickness, and thus, can withstand the stress generated at the fuel pressure of 35 MPa even if a material having low strength is selected.

In other words, a saturation magnetic flux density of the fixed core 107 (stator) is higher than a saturation magnetic flux density of the adapter 140 (pipe). The adapter 140 is configured using a member separate from the fixed core 107, and is directly press-fitted and fixed to the fixed core 107. As a result, for example, the manufacturing cost of the adapter 140 can be reduced while ensuring the magnetic characteristics of the fixed core 107.

Here, the tensile strength of the fixed core 107 (stator) is lower than the tensile strength of the adapter 140 (pipe). As a result, for example, it becomes possible to easily process the fixed core 107 while ensuring the strength of the adapter 140 even if a shape of the fixed core 107 is complicated.

In the present embodiment, a welded portion between the adapter 140 which is the first component and the fixed core 107 which is the second component is a butt-welded portion having a butt-joint configuration. Butt portions of the adapter 140 and the fixed core 107 need to prevent the leakage of high-pressure fuel filling the inside the fuel injection valve.

A mounting portion 301 of the adapter 140 of the fuel injection valve and a mounting portion 302 of the fixed core 107 are press-fitted so as to make radial contact, and butt welding is performed on the entire circumference at a butt-welded portion 303 to seal the fuel. Since the mounting portion 301 of the adapter 140 and the mounting portion 302 of the fixed core 107 are press-fitted and fixed before welding, it is possible to suppress collapse of the adapter 140 caused by strain generated during welding.

In other words, the fixed core 107 (stator) has the mounting portion (stator-side mounting portion) 302 on the upstream side in a fuel flow direction, and the adapter 140 (pipe) has the mounting portion (adapter-side mounting portion or pipe-side mounting portion) 301 on the downstream side. The mounting portion 302 and the mounting portion 301 are brought into direct contact and press-fitted with each other in the radial direction. The mounting portion 302 and the mounting portion 301 can be easily manufactured by cutting or the like, and a sealing property of high-pressure fuel is improved by fixing the mounting portion 302 and the mounting portion 301 by press fitting and butt welding.

Further, a downstream distal end portion 301*a* of the mounting portion 301 is butted so as to come into contact with an upper surface (upstream surface) of the mounting portion 302, and butt welding is performed at this contact portion. Specifically, the mounting portion 301 is located on the outer peripheral side (radially outer side) of the mounting portion 302, the downstream distal end portion 301*a* of the mounting portion 301 comes into contact with the fixed core 107 in the direction of the central axis 1*a*, and is butt-welded at this contact portion.

As a result, the butt welding between the mounting portion 302 and the mounting portion 301 is possible, and both the mounting portion 302 and the mounting portion 301 can be firmly fixed at low cost. Since the material used for the adapter 140 has higher strength than the fixed core 107, it makes sense to arrange the adapter 140 on the outer peripheral side where stress is high. Further, in the case of a material having high strength, the thickness can be made thin, and welding from the outer peripheral side is easy.

Here, the fixed core 107 has a protruding portion 107*a* (brim portion) that protrudes to the outer peripheral side on the downstream side (the side opposite to the adapter 140 side, the opposite side of the adapter 140) of the mounting portion 302. The protruding portion 107*a* is formed integrally with a member forming the fixed core 107.

The protruding portion 107*a* (brim portion) forms a magnetic path against an end portion (upper end) of the housing 103 opposing the protruding portion 107*a*, and forms a magnetic circuit 140M (see FIG. 1A).

As illustrated in FIG. 1B, when the fuel injection valve is connected to the fuel pipe 211 via the plate 251, the fixed core 107 is pulled downstream with respect to the adapter 140 by the fuel pressure load due to the fuel pressure inside the fuel injection valve. In both the case of FIG. 1A and the case of FIG. 1B, the two components of the adapter 140 and the fixed core 107 are press-fitted in the radial direction, and then, welded over the entire circumference and fixed in the fuel injection valve 1. Since a load applied to such a welded and fixed portion increases with the fuel pressure, it is necessary to provide the inexpensive fuel injection valve 1 by ensuring the welding strength capable of withstanding a high fuel pressure with the minimum necessary welding.

Next, an operation of the fuel injection valve will be described using FIG. 1A.

The injection hole cup support body 101 includes a small-diameter tubular portion 101A having a small diameter and a large-diameter tubular portion 101B having a large diameter. A guide portion 115 and an injection hole cup (fuel injection hole forming member) 116 having the fuel injection hole 117 are inserted or press-fitted inside a distal portion of the small-diameter tubular portion 101A, and an outer peripheral edge of a distal end surface of the injection hole cup 116 is welded to the small-diameter tubular portion 101A over the entire circumference. As a result, the injection hole cup 116 is fixed to the small-diameter tubular portion 22. The guide portion 115 has a function of guiding an outer circumference of a valve body distal end portion 114B when the valve body distal end portion 114B provided at a distal end of the needle valve 114A constituting the mover portion 114 moves up and down in the direction of the central axis 1*a* of the fuel injection valve 1.

A conical valve seat portion 39 is formed in the injection hole cup 116 on the downstream side of the guide portion 115. The valve body distal end portion 114B provided at the distal end of the needle valve 114A abuts on or separates from the valve seat portion 39, thereby blocking the flow of fuel or guiding the fuel to the fuel injection hole. A groove is formed at the outer circumference of the injection hole cup support body 101, and a seal member of a combustion gas, represented by a tip seal 131 made of resin, is fitted into this groove.

A needle valve guide portion 113 that guides the needle valve 114A constituting the mover is provided at an inner peripheral lower end portion of the fixed core 107. The needle valve 114A is provided with a guide portion 127. Although not illustrated, the guide portion 127 is partially provided with a chamfer, and the chamfer forms the fuel passage. The needle valve 114A having an elongated shape has its radial position regulated by the needle valve guide portion 113, and is guided so as to reciprocate straight in the direction of the central axis 1*a*. Note that a valve opening direction is upward in the direction of the central axis 1*a*, and a valve closing direction is downward in the direction of the central axis 1*a*.

A head portion 114C, which includes a stepped portion 129 having an outer diameter larger than a diameter of the needle valve 114A, is provided in an end portion of the needle valve 114A on the opposite side of an end portion in which the valve body distal end portion 114B is provided. A seating surface of a spring (first spring) 110 that biases the needle valve 114A in the valve closing direction is provided on an upper end surface of the stepped portion 129.

The mover portion 114 has the movable core 102 having a through-hole 102A through which the needle valve 114A penetrates at the center. A zero spring (second spring) 112 that biases the movable core 102 in the valve opening direction is held between the movable core 102 and the needle valve guide portion 113.

Since a diameter of the through-hole 102A is smaller than a diameter of the stepped portion 129 of the head portion 114C, an upper side surface of the movable core 102 held by the zero spring 112 and a lower end surface of the stepped portion 129 of the needle valve 114A abut on each other, and engage with each other under the action of the biasing force of the spring 110 that presses the needle valve 114A toward the valve seat portion 39 of the injection hole cup 116.

As a result, the movable core 102 and the needle valve 114A move together with respect to the upward movement of the movable core 102 against the biasing force of the zero spring 112 or the downward movement of the needle valve 114A along the biasing force of the zero spring 112. However, the needle valve 114A and the movable core 102 can move in different directions when a force that moves the needle valve 114A upward or a force that moves the movable core 102 downward independently acts on both the needle valve 114A and the movable core 102 regardless of the biasing force of the zero spring 112.

The fixed core 107 is press-fitted into an inner peripheral portion of the large-diameter tubular portion 101B of the injection hole cup support body 101, and is welded and joined at a press-fitting contact position. With such welding and joining, a gap formed between the inside of the large-diameter tubular portion 101B of the injection hole cup support body 101 and the outside air is sealed. The fixed core 107 is provided with a through-hole 107D having a diameter φCn at the center as a fuel introduction passage.

In other words, the adapter 140 and the fixed core 107 are fixed to each other in the state where a lower surface (surface on the downstream side) of the adapter 140 and an upper surface (surface on the upstream side) of the fixed core 107 are in direct contact with each other by press fitting.

A lower end of the spring 110 abuts on a spring receiving surface formed on an upper end surface of the stepped portion 129 of the needle valve 114A, and the other end of the spring 110 is received by an adjuster 54.

As a result, the spring 110 is held between the head portion 114C and the adjuster 54. It is possible to adjust the initial load by which the spring 110 presses the needle valve 114A against the valve seat portion 39 by adjusting the fixing position of the adjuster 54 in the direction of the central axis 1*a*.

The cup-shaped housing 103 is fixed to the outer circumference of the large-diameter tubular portion 101B of the injection hole cup support body 101. A through-hole is provided at the center of a bottom of the housing 103, and the large-diameter tubular portion 101B of the injection hole cup support body 101 is inserted into the through-hole. An outer peripheral wall portion of the housing 103 forms an outer peripheral yoke portion that opposes an outer peripheral surface of the large-diameter tubular portion 101B of the injection hole cup support body 101.

The electromagnetic coil 105 wound in an annular shape is arranged inside a tubular space formed by the housing 103. The electromagnetic coil 105 is formed of an annular coil bobbin 104 and a copper wire wound around the coil bobbin 104. A conductor 109 having rigidity is fixed to winding-start and winding-finish end portions of the electromagnetic coil 105, and led out from the through-hole provided in the protruding portion 107*a* of the fixed core 107.

Each outer circumference of the conductor 109, the fixed core 107, and the large-diameter tubular portion 101B of the injection hole cup support body 101 is molded by injecting insulating resin from an upper end opening portion of the housing 103 along the inner circumference, and is covered by a resin-molded body 121.

A plug to supply power from a high-voltage power supply or a battery power supply is connected to a connector 43A formed at a distal end portion of the conductor 109, and energization and non-energization are controlled by a controller (not illustrated). During energization of the electromagnetic coil 105, a magnetic attraction force is generated between the movable core 102 and the fixed core 107 of the mover portion 114 in a magnetic attraction gap by the magnetic flux passing through the magnetic circuit 140M, and the movable core 102 is moved upward by being attracted by a force exceeding a set load of the spring 110.

At this time, the movable core 102 engages with the head portion 114C of the needle valve 114A to move upward together with the needle valve 114A, and moves until an upper end surface of the movable core 102 abuts on a lower end surface of the fixed core 107. As a result, the valve body distal end portion 114B of the needle valve 114A separates from the valve seat portion 39, and the fuel passes through the fuel passage formed between the valve body distal end portion 114B and the valve seat portion 39 is injected from the fuel injection hole 117 at the distal end of the injection hole cup 116 into a combustion chamber of the internal combustion engine.

While the valve body distal end portion 114B of the needle valve 114A separates from the valve seat portion 39 and is pulled upward, the elongated needle valve 114A is guided to reciprocate straight along the direction of the central axis 1*a* by two sites of the needle valve guide portion 113 and the guide portion 115 of the injection hole cup 116.

When the energization to the electromagnetic coil 105 is cut off, the magnetic flux disappears so that the magnetic attraction force in the magnetic attraction gap also disappears. In this state, the spring force of the spring 110 overcomes the force of the zero spring 112 and acts on the entire mover portion 114 (the mover 102 and the needle valve 114A). As a result, the mover portion 114 is pushed back by the spring force of the spring 110 to a valve closing position where the valve body distal end portion 114B comes into contact with the valve seat portion 39.

While the valve body distal end portion 114B comes into contact with the valve seat portion 39 to be located at the valve closing position, the needle valve 114A is guided only by the needle valve guide portion 113 and does not come into contact with the guide portion 115 of the injection hole cup 116.

At this time, the stepped portion 129 of the head portion 114C abuts on the upper surface of the movable core 102 to move the movable core 102 downward (in the valve closing direction) by overcoming the force of the zero spring 112. When the valve body distal end portion 114B collides with the valve seat portion 39, the movable core 102 continues to move downward (in the valve closing direction) due to inertial force since the movable core 102 is the separate body from the needle valve 114A. At this time, friction due to fluid occurs between the outer circumference of the needle valve 114A and the inner circumference of the movable core 102, and the energy of the needle valve 114A that rebounds from the valve seat portion 39 in the valve opening direction is absorbed.

Since the movable core 102 having a large inertial mass is separated from the needle valve 114A, the rebound energy itself is also small. Further, the inertia force of the movable core 102 that has absorbed the rebound energy of the needle valve 114A is reduced by the absorption amount, and a repulsive force received after compressing the zero spring 112 also decreases, and thus, a phenomenon in which the needle valve 114A is moved again in the valve opening direction due to the rebound phenomenon of the movable core 102 is unlikely to occur. Thus, the rebound of the needle valve 114A is suppressed to the minimum, and a so-called secondary injection phenomenon in which the valve is open after the energization of the electromagnetic coil 105 is cut off and fuel is randomly injected is suppressed.

COMPARATIVE EXAMPLES

Next, problems of fuel injection valves according to comparative examples of the present invention will be described with reference to FIGS. 4 to 7.

Figure 4:
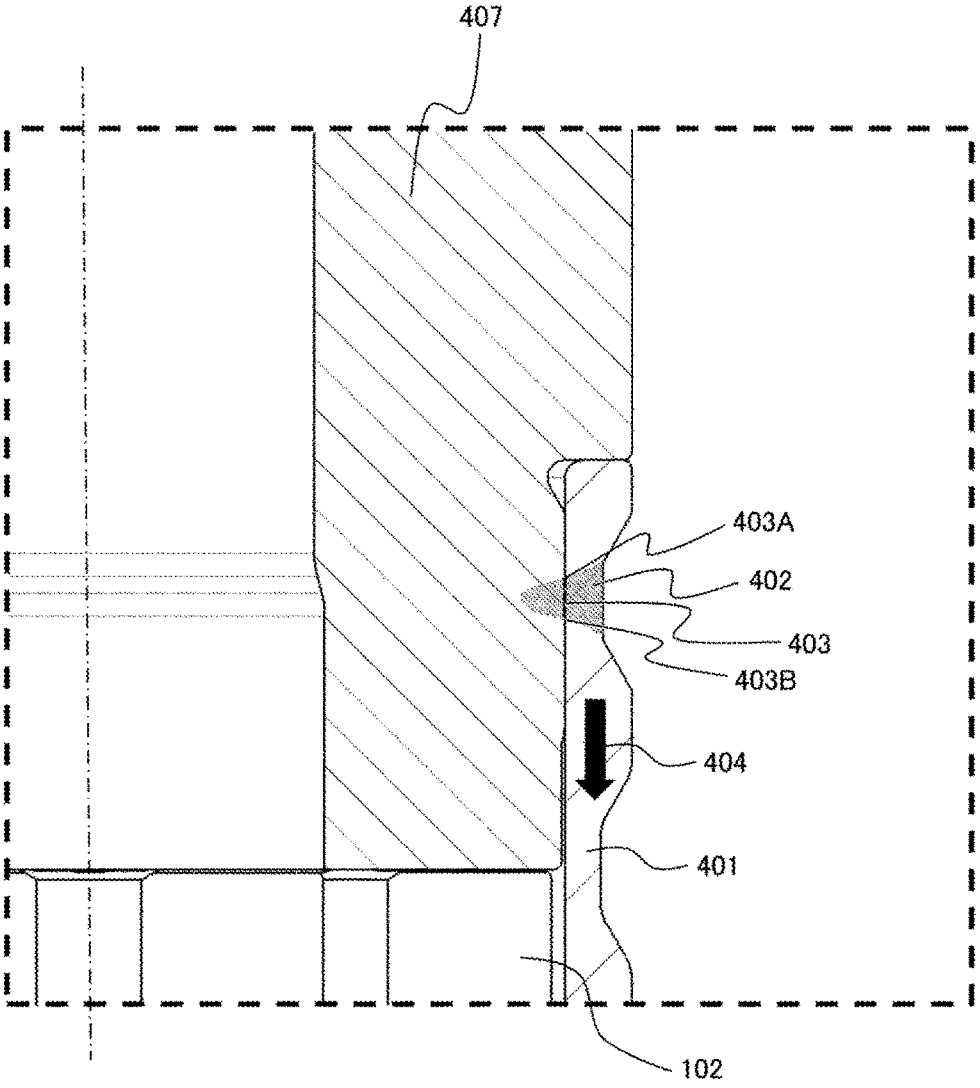
FIG. 4 is an enlarged cross-sectional view of a welded portion between a fixed core 407 and an injection hole cup support body 401 according to Comparative Example 1 of the present invention.

FIG. 4 is an enlarged cross-sectional view of a welded portion between a fixed core 407 and an injection hole cup support body 401 according to Comparative Example 1 of the present invention. Note that FIG. 4 is an enlarged view of part IV of FIG. 1A.

The fixed core 407 is press-fitted into the injection hole cup support body 401, and then, joined to the injection hole cup support body 401 by lap welding.

Due to a fuel pressure, the injection hole cup support body 401 receives loads to the radially outer side and downward in the direction of the central axis 1*a* of the fuel injection valve 1, but the fixed core 407 is fixed in the direction of the central axis 1*a*, and thus, the load that mainly acts on a lap-welded portion 402 is a load 404 received by the injection hole cup support body 401 downward in the direction of the central axis 1*a* of the fuel injection valve 1.

When a boundary surface during the lap welding of the fixed core 407 and the injection hole cup support body 401 is denoted by 403, a shear load is generated on the boundary surface 403. High stress is generated at an upper end 403A of the boundary surface 403 due to the shear load. This is because the stress is concentrated on the upper end 403A when the load downward in the direction of the central axis 1*a* of the fuel injection valve 1 is applied to the injection hole cup support body 401 even if the length of the boundary surface 403 during the lap welding is increased.

When the fuel pressure is 20 MPa, an axial load is small as illustrated in FIG. 2, and thus, the stress generated at the upper end 403A of the boundary surface 403 is relatively small, and sufficient strength can be secured.

Figure 5A:
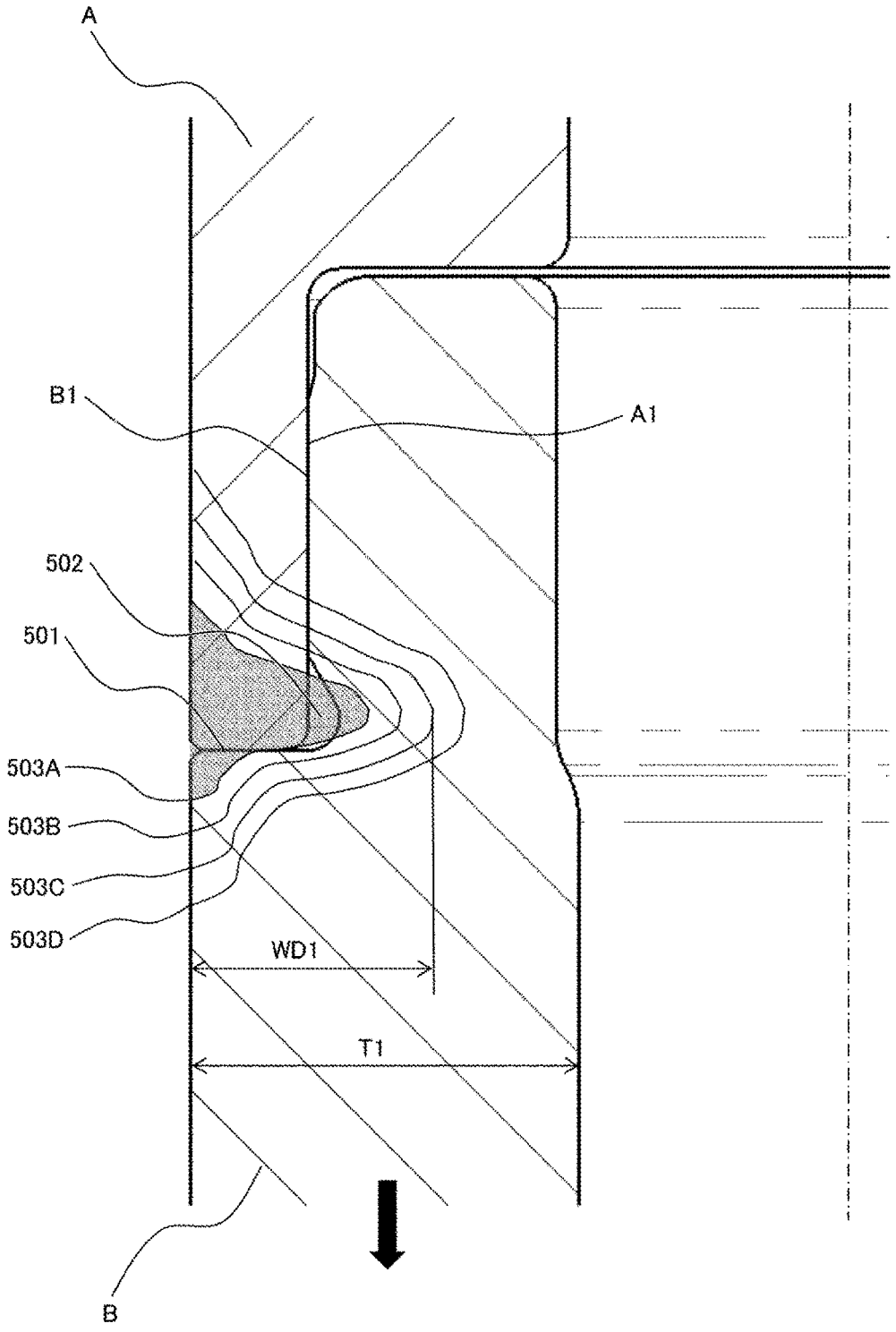
FIG. 5A is an enlarged cross-sectional view of a welded portion between a first component A and a second component B according to Comparative Example 2 of the present invention.

On the other hand, when the fuel pressure of, for example, 35 MPa, higher than the conventional one, is used, the axial load increases as illustrated in FIG. 2. Accordingly, the stress generated at a base metal and a welding boundary portion also increases due to the shearing force since a load direction and a base metal boundary are parallel to each other in the lap welding, and there is a possibility that it is difficult to ensure sufficient strength. FIG. 5A is an enlarged cross-sectional view of a welded portion between a fixed core B and an adapter A according to Comparative Example 2 of the present invention. FIG. 5A illustrates a shape of a melted and re-solidified portion (hereinafter referred to as a melted portion) when a butt portion between the fixed core B and the adapter A is butt-welded. When the two components of the fixed core B and the adapter A are butted, a gap 502 is formed by digging a corner of the fixed core B as illustrated such that butt surfaces 501 come into close contact with each other or chamfering a corner of the adapter A although not illustrated. When the butt portion is welded, laser welding is performed such that the melted portion has a shape as illustrated by 503B in order to completely fill the gap 502 with molten metal.

The reason why the gap 502 is completely filled with the molten metal is because the stress increases depending on a shape of the gap when a load in the arrow direction in the drawing is applied to the component B, which may reduce the strength of the welded portion. That is, there is a possibility that the welded portion shape 504 protruding into such an abutting gap causes stress concentration even in the butt welding. Such an example is illustrated in FIG. 5B.

Figure 5B:
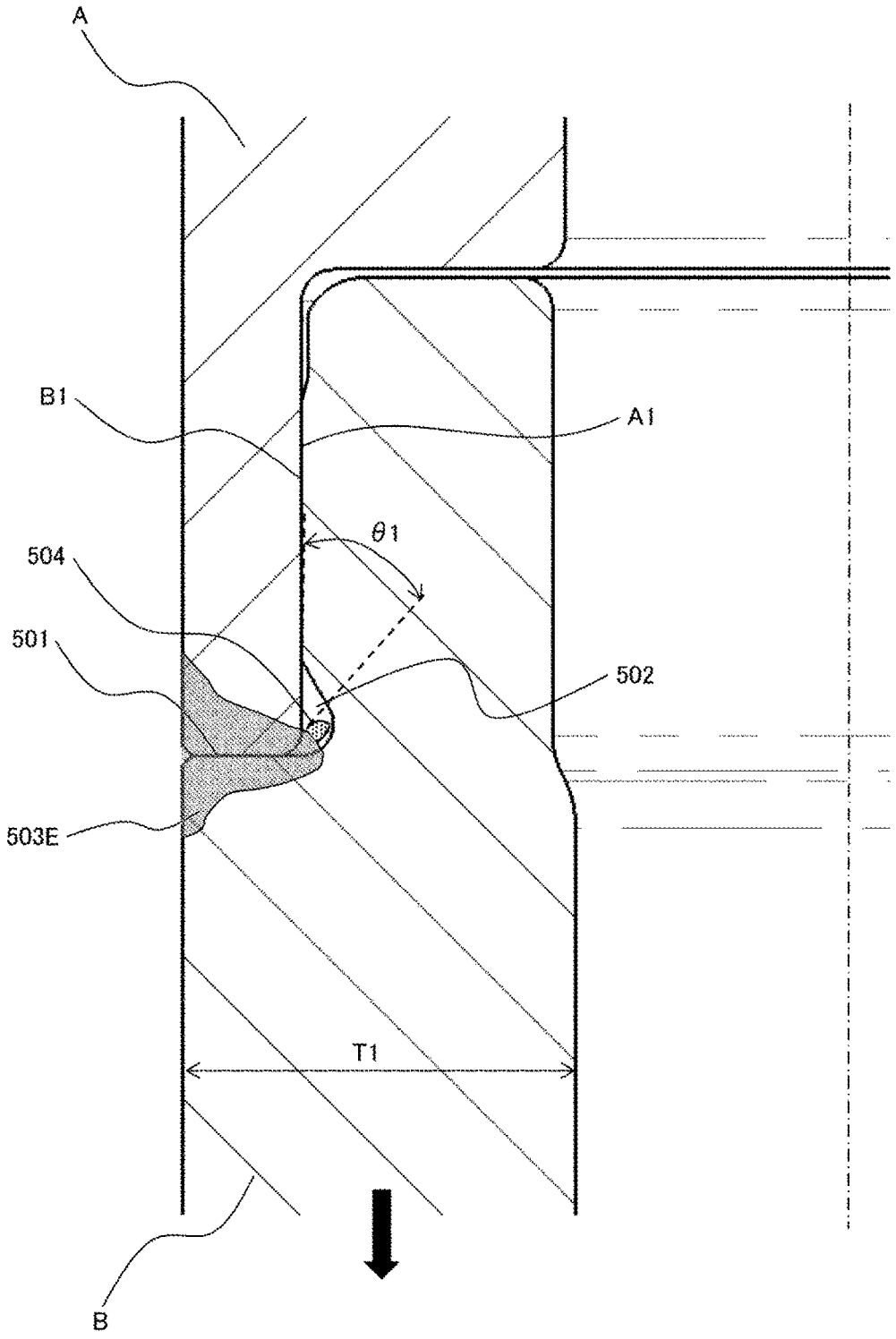
FIG. 5B is an enlarged cross-sectional view of a welded portion between a first component A and a second component B according to Comparative Example 3 of the present invention.

FIG. 5B is an enlarged cross-sectional view of a welded portion between a first component A and a second component B according to Comparative Example 3 of the present invention.

In the case of a shape of the welded portion as illustrated in FIG. 5B, there is a possibility that a part 504 of metal 503E after melting and re-solidifying locally swells to protrude into a gap 502 between the first component A and the second component B. Since an angle θ1 formed by the welded portion shape 504 is small with respect to an axial load 510 caused by the fuel pressure, this gap shape causes stress concentration to increase the stress, which reduces the strength of the welded portion 503E.

On the other hand, a distal end portion (innermost portion) in a welding direction (welding depth direction) is formed to be located on the inner side in the welding direction (the e right side in FIG. 5A) with respect to a press-fitting portion (a boundary portion between a press-fitting portion inner peripheral surface A1 of the first component A and a press-fitting portion outer peripheral surface B1 of the second component B) as in butt-welded portions 503B, 503C, and 503D in FIG. 5A. The welded portions 503B, 503C, and 503D are formed so as to fill all gaps formed between the first component A and the second component B before welding. As a result, it is possible to suppress reduction in strength of the welded portions 503B, 503C, and 503D caused by the increase in stress due to the shape of the gap 502.

Note that a weld penetration depth WD1 varies with respect to an intended target in the manufacturing process. Even if welding is performed with a penetration shape of 503B as a target, there is a possibility that a penetration shape 503A smaller than that is actually obtained to leave the gap 502 after welding. Accordingly, in order to fill the entire gap 502 with the molten metal, a weld shape 503C is set as a target such that a weld shape 503B can be ensured even if variations occur and the penetration depth becomes small.

Meanwhile, coaxial accuracy is required in the fuel injection valve, there is a demand for minimization of heat input during welding. In the case of the weld shape illustrated in FIG. 5A, it is conceivable that the penetration is set to 608 having larger penetration in consideration of the occurrence of variations described above even when a penetration shape of 503C is set as the target. However, when ⅔ or more of a thickness T1 of the component B is melted, a deformation amount during welding becomes large, so that the coaxial accuracy of the fuel injection valve is likely to deteriorate.

Figure 5C:
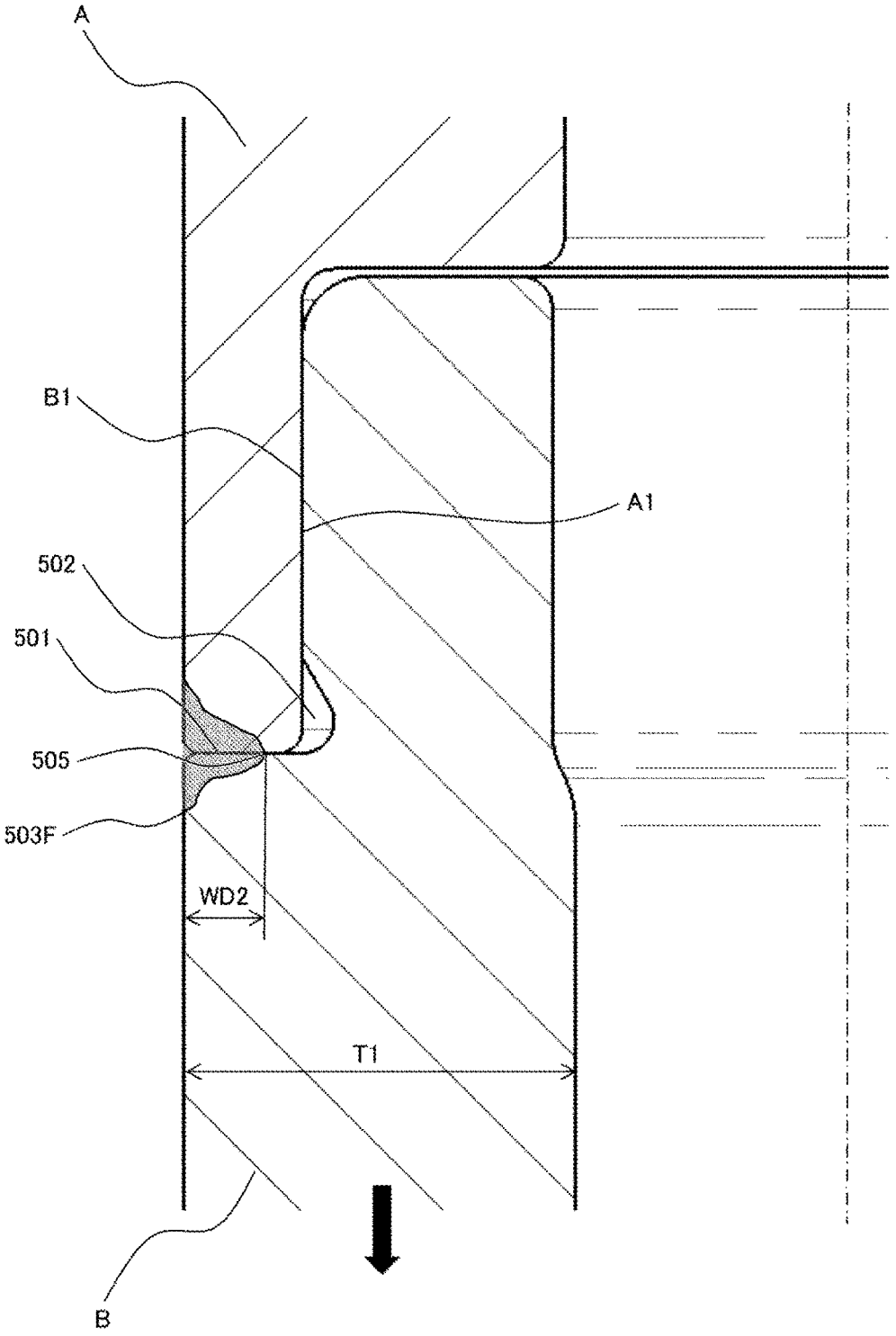
FIG. 5C is an enlarged cross-sectional view of a welded portion between a first component A and a second component B according to Comparative Example 4 of the present invention.

FIG. 5C is an enlarged cross-sectional view of a welded portion between a first component A and a second component B according to Comparative Example 4 of the present invention.

FIG. 5C illustrates a shape of the welded portion when a penetration depth of butt welding is WD2 in order to suppress deterioration of coaxial accuracy. When the penetration depth WD2 equal to or shorter than an abutting length is set, it is clear that an end portion 505 of a welded portion shape causes stress concentration in a load direction indicated by the arrow. Accordingly, when a weld penetration shape is made shorter than the butt length in butt welding, there is a possibility that it is difficult to ensure sufficient rigidity and strength against a load generated by a high fuel pressure.

Typically, a lubricant is used at the time of press-fitting two components in order to prevent galling, reduce a load at the time of press fitting, and reliably bringing abutting portions of the two components in contact with each other. The influence of the lubricant will be described with reference to FIGS. 6 and 5A.

Figure 6:
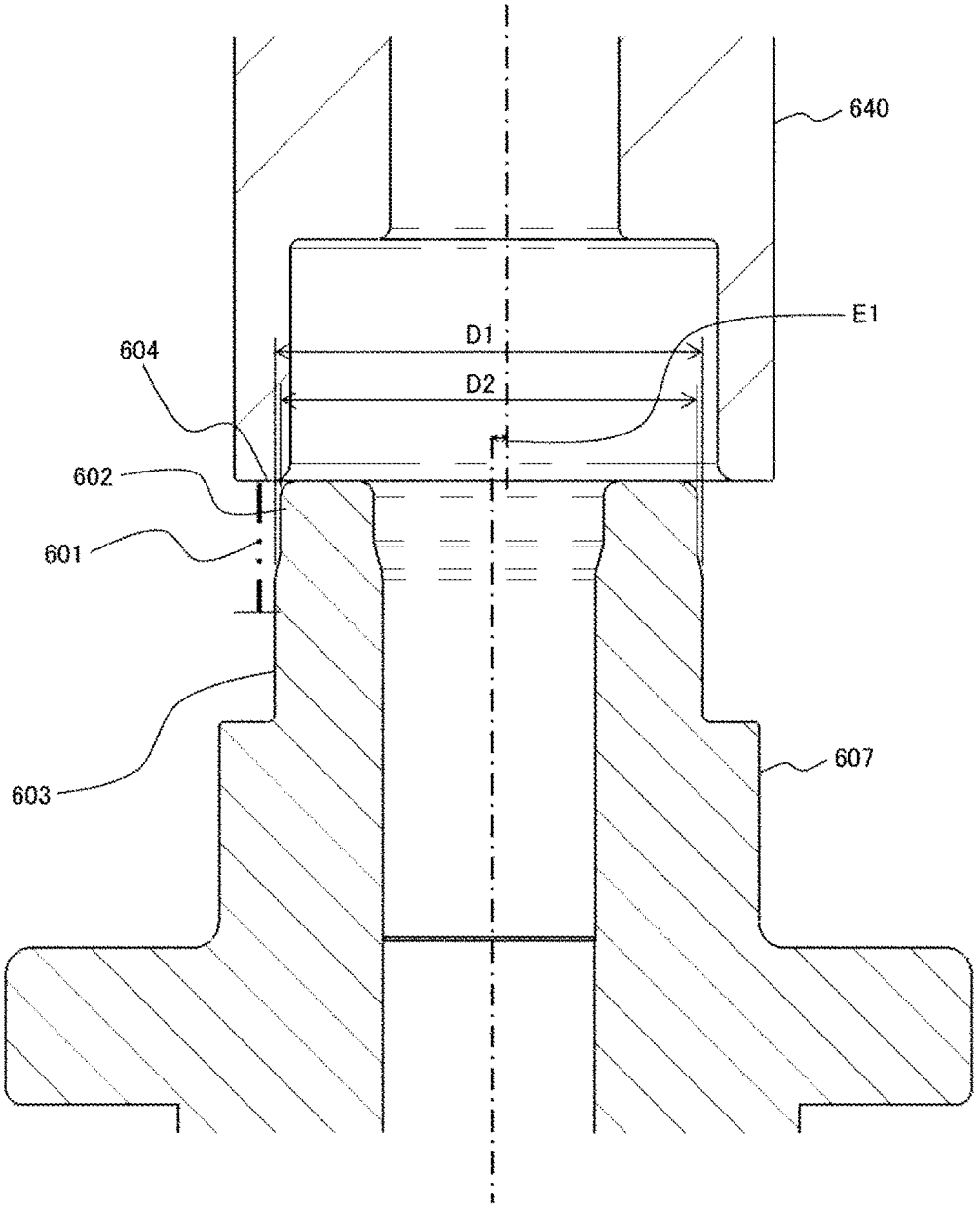
FIG. 6 is an enlarged cross-sectional view illustrating a state before press fitting of a fixed core 607 and an adapter 640 according to Comparative Example 5 of the present invention.

FIG. 6 is an enlarged cross-sectional view illustrating a state before press fitting of a fixed core 607 and an adapter 640 according to Comparative Example 5 of the present invention.

The lubricant can be applied to either an inner diameter of the adapter (first component) 640 or an outer diameter of the fixed core (second component) 607, but it is easy and inexpensive to apply the lubricant to a range indicated by 601 on an outer diameter portion of the fixed core 607 as illustrated in FIG. 6A. Before press-fitting the adapter 640 and the fixed core 607, an axial deviation E1 between both the components is made as small as possible, but it is industrially difficult to completely set the axial deviation E1 to zero. Accordingly, a beak portion (small diameter portion) 602 having an outer diameter slightly smaller than a press-fitting diameter D1 is provided on the upstream side (upper end side) of the press-fitting portion of the fixed core 607.

Even if there is the axial deviation E1 between the two components, the beak portion 602 is often used industrially since the amount of the axial deviation can be made equal to or smaller than a difference between the press-fitting diameter D1 and a peak diameter D2 as the two components are guided to each other. However, since a step between the beak portion 602 and a press-fitting portion 603 is small (for example, about 0.04 mm), the amount of the axial deviation E1 between both the components is larger before the press fitting. In this case, there is a possibility that the lubricant having adhered to the beak portion 602 even adheres to a portion 604 to be welded after abutment. At the time of welding, molten metal has a shape like 503A, 503B, 503C, and 503D in FIG. 5A, and thus, if the adhering lubricant is directly heated by a laser, the heated lubricant is gasified to generate blowholes.

When the fixed core 607 and the adapter 640 of FIG. 6 are press-fitted, the state illustrated in FIG. 5A is obtained.

Note that the adapter 640 corresponds to the first component A in FIG. 5A, and the fixed core 607 corresponds to the second component B in FIG. 5A. When the fixed core 607 and the adapter 640 are press-fitted, the lubricant is pushed downward in the drawing and is accumulated in the gap 502. Since the molten metal has a shape like 503A, 503B, 503C, and 503D at the time of welding, the lubricant accumulated in the gap 502 is directly heated. The heated lubricant is gasified to generate blowholes.

Figure 7:
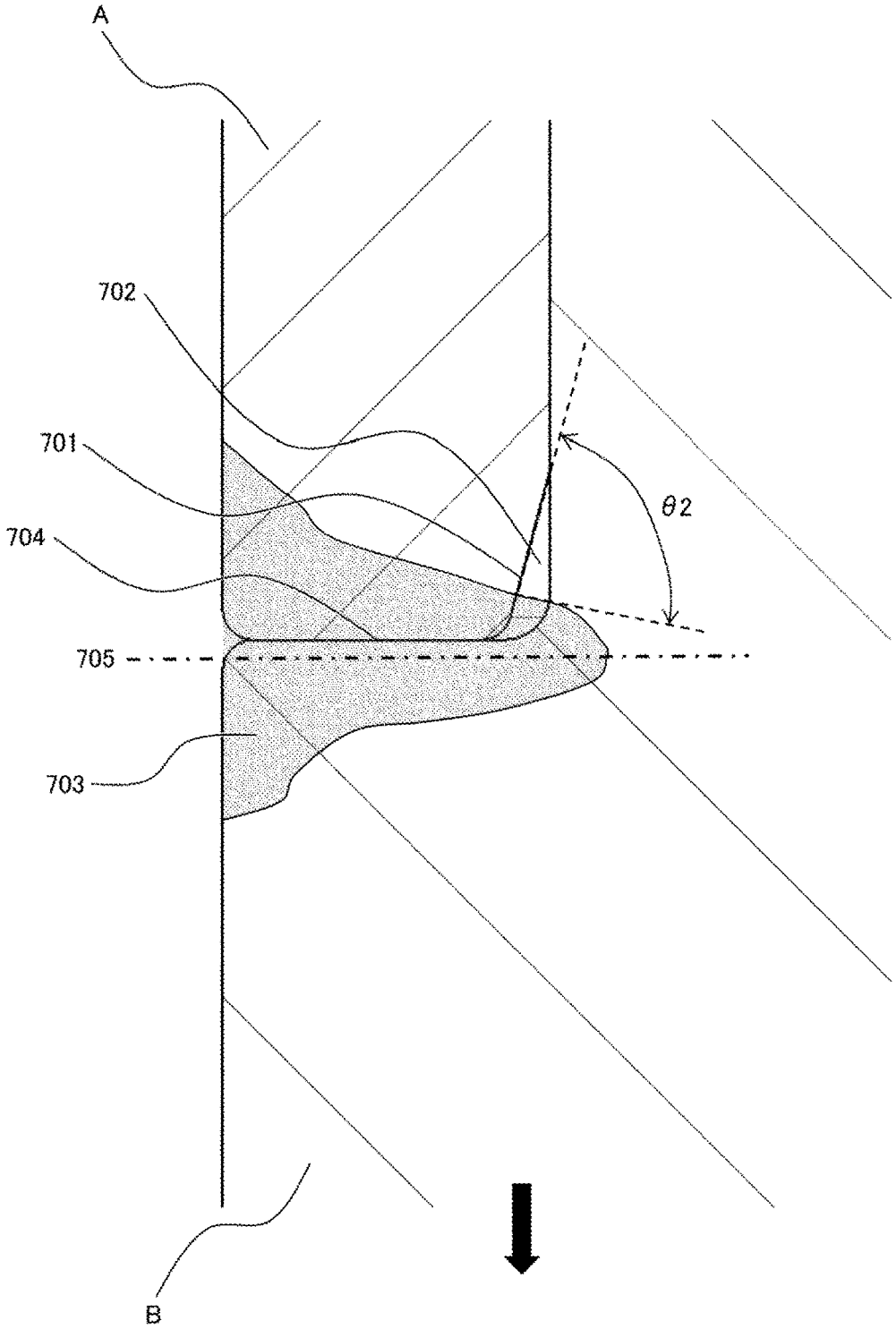
FIG. 7 is an enlarged cross-sectional view of a welded portion between a first component A and a second component B according to Comparative Example 6 of the present invention.

FIG. 7 is an enlarged cross-sectional view of a welded portion between a first component A and a second component B according to Comparative Example 6 of the present invention.

Even when a chamfer 701 is provided on the first component A in order to prevent a lubricant from entering the welded portion and a gap 702 larger than the conventional one is provided as illustrated in FIG. 7, molten metal has a shape like 703 at the time of welding, and thus, the lubricant accumulated in the gap 702 is directly heated so that there is a possibility that the heated lubricant is gasified to generate blowholes. Further, even if the lubricant does not come into contact with the welded portion 703 and no blowhole is generated, an angle θ2 formed by a base metal and the welded portion 703 is smaller than 90 degrees, so that there is a possibility that stress increases and strength decreases. Note that 704 denotes a butt surface (butt-welded portion), and 705 denotes a central portion in a direction (up-and-down direction in FIG. 7) orthogonal to a welding depth direction of the butt-welded portion 704 (the right direction in FIG. 7).

As described above, it is difficult to completely eliminate the axial deviation during assembly in the butt-welded portion in the configurations like the comparative examples, and blowholes are likely to be generated due to the applied lubricant in the configurations. Even if no blowhole is generated, the angle between the base metal and the welded portion is smaller than 90 degrees, so that the strength is likely to decrease in the configurations. The present embodiment proposes the configuration (shape) of the welded portion in which blowholes caused by the lubricant are less likely to be generated, and the strength is less likely to decrease.

Figure 8:
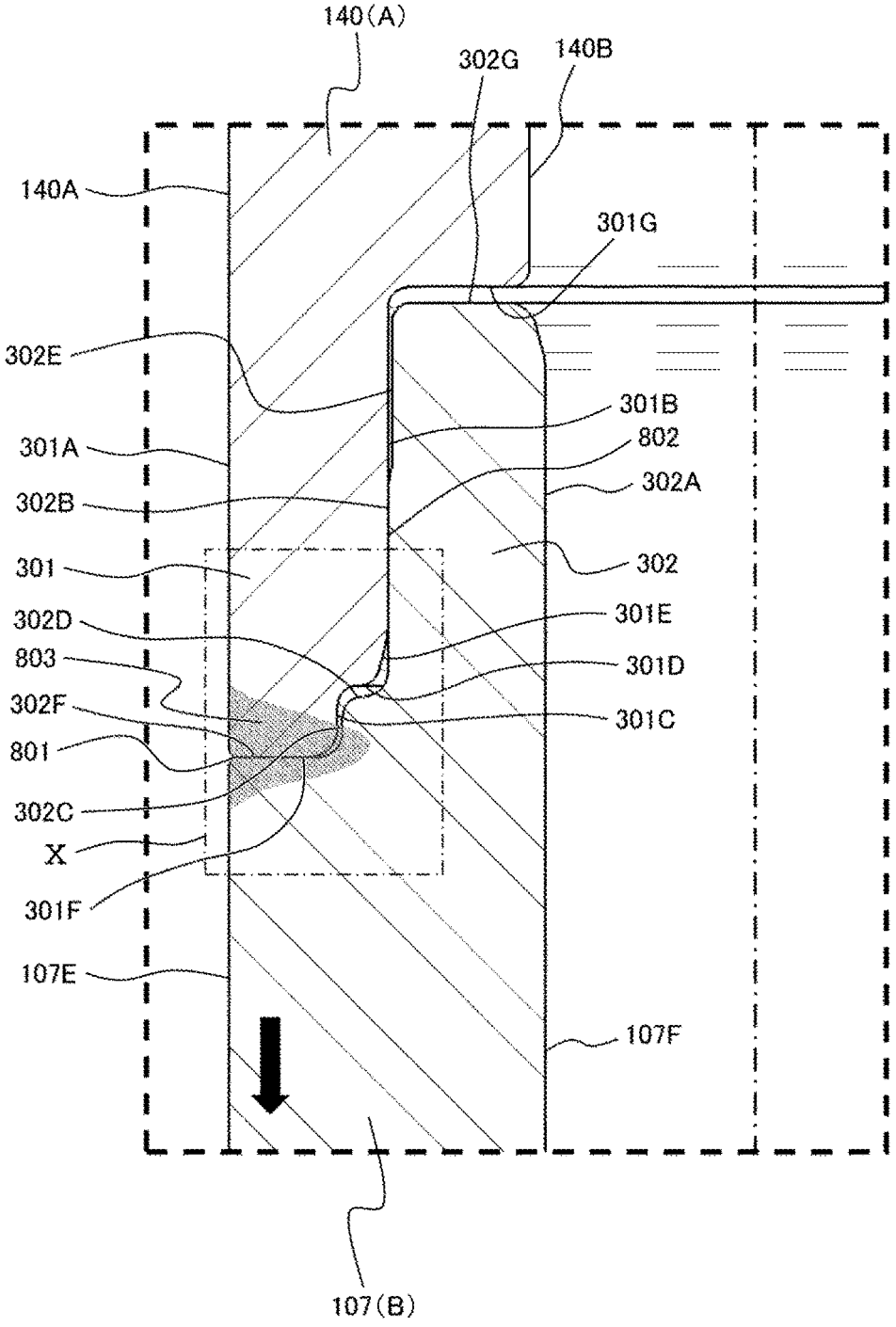
FIG. 8 is an enlarged cross-sectional view of a welded portion between an adapter 140 and a fixed core 107 according to the embodiment of the present invention.

FIG. 8 is an enlarged cross-sectional view of the welded portion between the adapter 140 and the fixed core 107 according to the embodiment of the present invention.

In the present embodiment, the adapter 140 and the fixed core 107 are butted to perform butt welding.

The mounting portion 301 is formed at the lower end portion (the end portion on the fixed core 107 side) of the adapter 140. An outer peripheral surface 301A of the mounting portion 301 has the same diameter as an outer peripheral surface 140A of the adapter 140. A first inner peripheral surface 301B of the mounting portion 301 is enlarged in diameter with respect to an inner peripheral surface 140B on the upstream side of the adapter 140 so as to have an inner diameter larger than an inner diameter φCn on the upstream side of the adapter 140. That is, a radial step surface 301G is formed between the first inner peripheral surface 301B of the mounting portion 301 and the inner peripheral surface 140B of the adapter 140.

Further, a second inner peripheral surface 301C having a larger diameter than the first inner peripheral surface 301B is formed at a lower end portion of the mounting portion 301. The second inner peripheral surface 301C is enlarged in diameter with respect to the first inner peripheral surface 301B, and a radial step surface 301D is formed between the first inner peripheral surface 301B and the second inner peripheral surface 301C.

The mounting portion 302 is formed at the upper end portion (the end portion on the adapter 140 side) of the fixed core 107. An inner peripheral surface 302A of the mounting portion 302 has the same diameter as an inner peripheral surface 107F of the fixed core 107. A first outer peripheral surface 302B of the mounting portion 302 is reduced in diameter with respect to an outer peripheral surface 107E on the downstream side of the fixed core 107 so as to have an outer diameter smaller than an outer diameter on the downstream side of the fixed core 107. That is, radial step surfaces 302F and 302D are formed between the first outer peripheral surface 302B of the mounting portion 302 and the outer peripheral surface 107E of the fixed core 107.

Further, a second outer peripheral surface 302C having a larger diameter than the first outer peripheral surface 302B is formed at a lower end portion of the mounting portion 302. The second outer peripheral surface 302C is enlarged in diameter with respect to the first outer peripheral surface 302B, and the radial step surface 302D is formed between the first outer peripheral surface 302B and the second outer peripheral surface 302C.

A lower end surface 301F of the mounting portion 301 and the step surface 302F of the mounting portion 302 oppose each other, and the step surface 301G of the mounting portion 301 and an upper end surface 302G of the mounting portion 302 oppose each other. The lower end surface 301F of the mounting portion 301 and the step surface 302F of the mounting portion 302 abut on each other, but a gap is provided between the step surface 301G of the mounting portion 301 and the upper end surface 302G of the mounting portion 302. Furthermore, the first outer peripheral surface 302B, the step surface 302D, and the second outer peripheral surface 302C of the mounting portion 302 oppose the first inner peripheral surface 301B, the step surface 301D, and the second inner peripheral surface 301C of the mounting portion 301, respectively.

Note that a chamfer 301E is provided between the first inner peripheral surface 301B of the mounting portion 301 and the step surface 301D. Further, a beak portion 302E is provided at an upper end portion of the first outer peripheral surface 302B of the mounting portion 302. The chamfer 301E and the beak portion 302E have the same functions as the chamfer 701 and the beak portion 602 described in the comparative examples.

At a site where the chamfer 301E of the mounting portion 301 and the first outer peripheral surface 302B of the mounting portion 302 oppose each other in the radial direction, an inner diameter of the chamfer 301E of the mounting portion 301 is larger than an outer diameter of the first outer peripheral surface 302B of the mounting portion 302, and is enlarged in diameter downward. Further, at a site where the second inner peripheral surface 301C of the mounting portion 301 and the second outer peripheral surface 302C of the mounting portion 302 oppose each other in the radial direction, an inner diameter of the second inner peripheral surface 301C of the mounting portion 301 is larger than an outer diameter of the second outer peripheral surface 302C of the mounting portion 302.

Reference sign 803 represents a shape of the welded portion in which metal melted by welding is re-solidified. That is, the fuel injection valve 1 of the present embodiment includes the adapter (first component) 140 and the fixed core (second component) 107 that are press-fitted and butt-welded to each other.

Further, an abutting surface (butt surface) 801 are formed between the lower end surface 301F of the mounting portion 301 of the first component 140 and the step surface 302F of the mounting portion 302 of the second component 107 to come into contact with both the lower end surface 301F and the step surface 302F, and the butt-welded portion 803 is formed along the abutting surface on this abutting surface 801.

The mounting portion 301 of the adapter 140 and the mounting portion 302 of the fixed core 107 are press-fitted so as to be pressed against each other in the radial direction, thereby forming a press-fitting fitting portion 802. That is, the mounting portion 301 of the adapter 140 and the mounting portion 302 of the fixed core 107 are firmly fixed by the butt-welded portion 803 in addition to the press-fitting portion 802.

In the configuration illustrated in FIG. 4, there is a possibility that the fixing strength is insufficient due to the stress concentration. In the present embodiment, however, the butt surface 801 between the adapter 140 and the fixed core 107 is perpendicular to the main load direction indicated by the arrow. Accordingly, the load is applied substantially uniformly on the entire butt surface 801, and the maximum stress thus generated is smaller than that in the lap welding illustrated in FIG. 4. Therefore, the present embodiment can improve the fixing strength.

As a result, the butt-welded portion 803 is welded so as to have the strength capable of withstanding a high fuel pressure load. The butt welding has a higher joint efficiency than the lap welding that is performed by the conventional fuel injection valve, so that the strength is improved for the same penetration amount.

Figure 9:
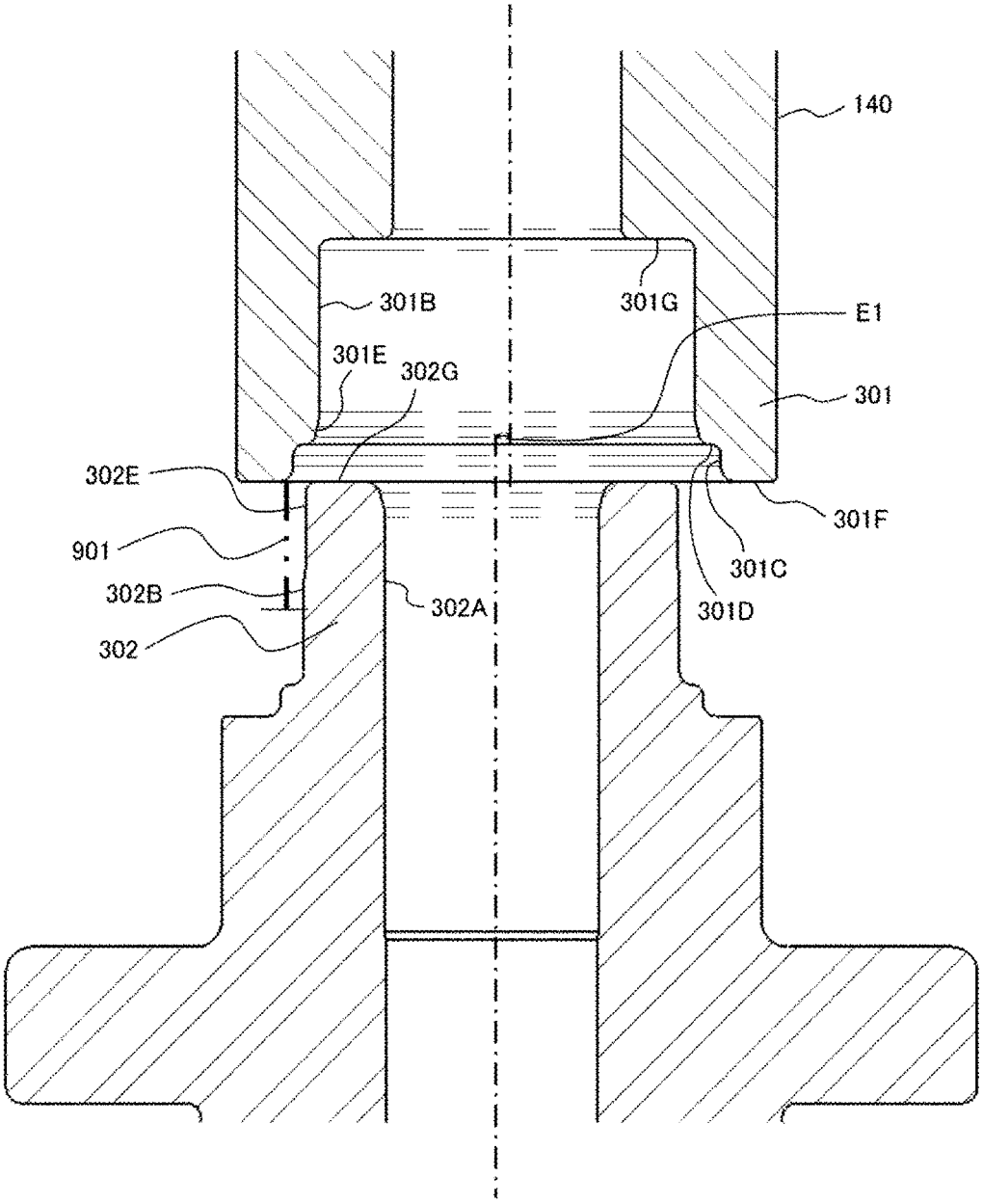
FIG. 9 is an enlarged cross-sectional view illustrating a state before press fitting of the fixed core 107 and the adapter 140 according to the embodiment of the present invention.

FIG. 9 illustrates an example of applying the lubricant in the present embodiment. FIG. 9 is an enlarged cross-sectional view illustrating a state before press fitting of the fixed core 107 and the adapter 140 according to the embodiment of the present invention.

The lubricant can be applied to either the inner diameter (inner circumference) of the first component 140 or the outer diameter (outer circumference) of the second component 107, but it is industrially easy and inexpensive to apply the lubricant to the outer diameter of the second component 107. In the present embodiment, the lubricant is applied to a portion indicated by 901. That is, the lubricant is applied to an upper end portion including the beak portion 302E on the first outer peripheral surface 302B of the mounting portion 302 of the second component 107.

Before press-fitting the first component 140 and the second component 107, the axial deviation E1 between both the components is made as small as possible, but it is industrially difficult to completely eliminate the axial deviation E1. Accordingly, the beak portion 302E having the outer diameter slightly smaller than the press-fitting diameter is provided at the upper end portion of the press-fitting portion 302 of the second component 107. In the present embodiment, the step 301D (for example, about 0.5 mm in the radial direction) that is larger than the axial deviation E1 between both the components before the press fitting is provided between the press-fitting fitting portion 802 and the welded portion 803 of the adapter 140. Accordingly, the lubricant applied to the beak portion 302E does not adhere to the welded portion 803 after being abutted. Accordingly, it is possible to suppress the generation of blowholes at the time of welding in which the lubricant is heated by the laser.

Figure 10:
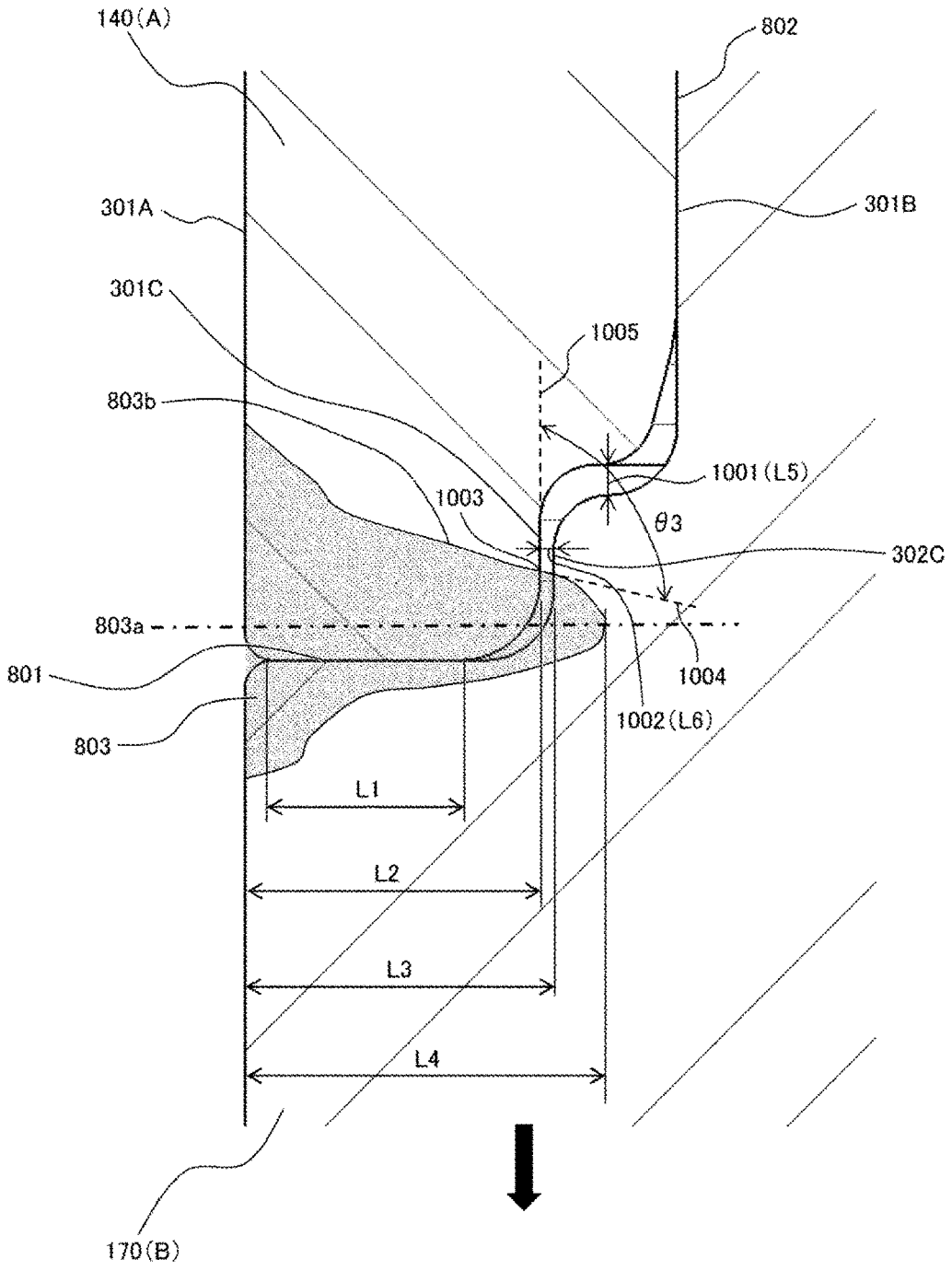
FIG. 10 is an enlarged cross-sectional view of the welded portion between the adapter 140 and the fixed core 107 according to the embodiment of the present invention.

This will be described with reference to FIG. 10 together with FIG. 9. FIG. 10 is an enlarged cross-sectional view of the welded portion between the adapter 140 and the fixed core 107 according to the embodiment of the present invention. Note that FIG. 10 is an enlarged view of part X of FIG. 8.

A first gap 1001 is formed by the first component 140 and the second component 107 between the press-fitting fitting portion 802 of the first component 140 and the second component 107 and the butt-welded portion 803, and a second gap 1002 is formed by the first component 140 and the second component 107 between the first gap 1001 and the butt-welded portion 803. That is, the first gap 1001 and the second gap 1002 are formed between the chamfer 301E, the step surface 301D, and the second inner peripheral surface 301C of the mounting portion 301, and the first outer peripheral surface 302B, the step surface 302D, and the second outer peripheral surface 302C of the mounting portion 302.

Note that a chamfer 301E is provided between the first inner peripheral surface 301B of the mounting portion 301 and the step surface 301D.

In FIG. 10, as an example, the first gap 1001 is formed in a direction (radial direction) intersecting a direction of the press-fitting fitting 802 (direction of the central axis 1*a*), and the second gap 1002 is formed in a direction intersecting the first gap 1001 (direction of the central axis 1*a*).

Further, the volume of the first gap 1001 is larger than the volume of the second gap 1002.

Although the lubricant is pushed downward in the drawing at the time of press-fitting the adapter 140 and the fixed core 107, the possibility that the lubricant flows into the second gap 1002 is low since the volume of the first gap 411 is larger than the volume of the lubricant adhering to the beak portion 512 and the press-fitting fitting portion 802. Even if the lubricant tries to flow into the second gap 1002, the possibility that the lubricant enters the abutting portion 801 beyond the second gap 1002 is extremely low since the flow path resistance is increased by reducing an interval of the second gap 1002 with respect to the first gap 1001. The volume of the lubricant adhering to the beak portion 302E and the press-fitting fitting portion 802 can be calculated by multiplying an application area by a membrane thickness of the lubricant. The membrane thickness of the lubricant can be experimentally measured in advance. A specific numerical value of this membrane thickness is, for example, about 5 μm.

In the manufacturing process, the lubricant can be prevented from entering the abutting portion 801 due to gravity by setting a direction opposite to the direction illustrated in FIG. 9 (upside down). In the present embodiment, the lubricant does not adhere to the abutting portion 801 when the adapter 140 and the fixed core 107 are press-fitted, and it is possible to suppress the generation of blowholes at the time of welding.

Next, the reason why the strength of the welded portion 803 of the present embodiment increases will be described with reference to FIG. 10.

In the present embodiment, a boundary between the high-pressure fuel and the atmosphere is constituted by two or more components including the first component A and the second component B. The first component A and the second component B are fitted and press-fitted by the small-diameter-side outer diameter 302B of the second component B provided with a stepped portion on the outer diameter side (outer peripheral side), and the large-diameter-side inner diameter 301B of the first component A provided with a stepped portion on the inner diameter side (inner peripheral side), and come into contact with each other at the abutting surface 801 to be positioned. The stepped portion of the first component A and the stepped portion of the second component B are formed such that an interval is provided therebetween and surfaces forming both the stepped portions are located along each other. The first component A corresponds to the adapter 140 or the mounting portion 401 of the adapter 140, and the second component B corresponds to the fixed core 107 or the mounting portion 402 of the fixed core 107. The butt welding is performed from a direction parallel or substantially parallel to the abutting surface 801 between the first component A and the second component B to form the butt-welded portion 803.

The butt-welded portion 803 is formed such that a weld joint length L2 is larger than an abutting length L1 between the first component A and the second component B. Further, a weld penetration depth L4 of the butt-welded portion 803 is set to be equal to or longer than a length L3 between the outer peripheral surface of the fixed core 107 and the second outer peripheral surface 302C of the mounting portion 302 so as to reach a step portion 302C of the second component B. Since there is an industrial variation in the penetration depth at the time of welding, melting is actually performed up to the position of L4. A weld penetration center 803*a* is located closer to a component arranged on the outer peripheral side of the press-fitting portion 802 than the abutting surface 507. That is, the center 803*a* in a direction (up-and-down direction in FIG. 6A) orthogonal to the welding direction of the butt-welded portion 803 (right direction in FIG. 10) is located closer to the first component A than the abutting surface 801.

Figure 11:
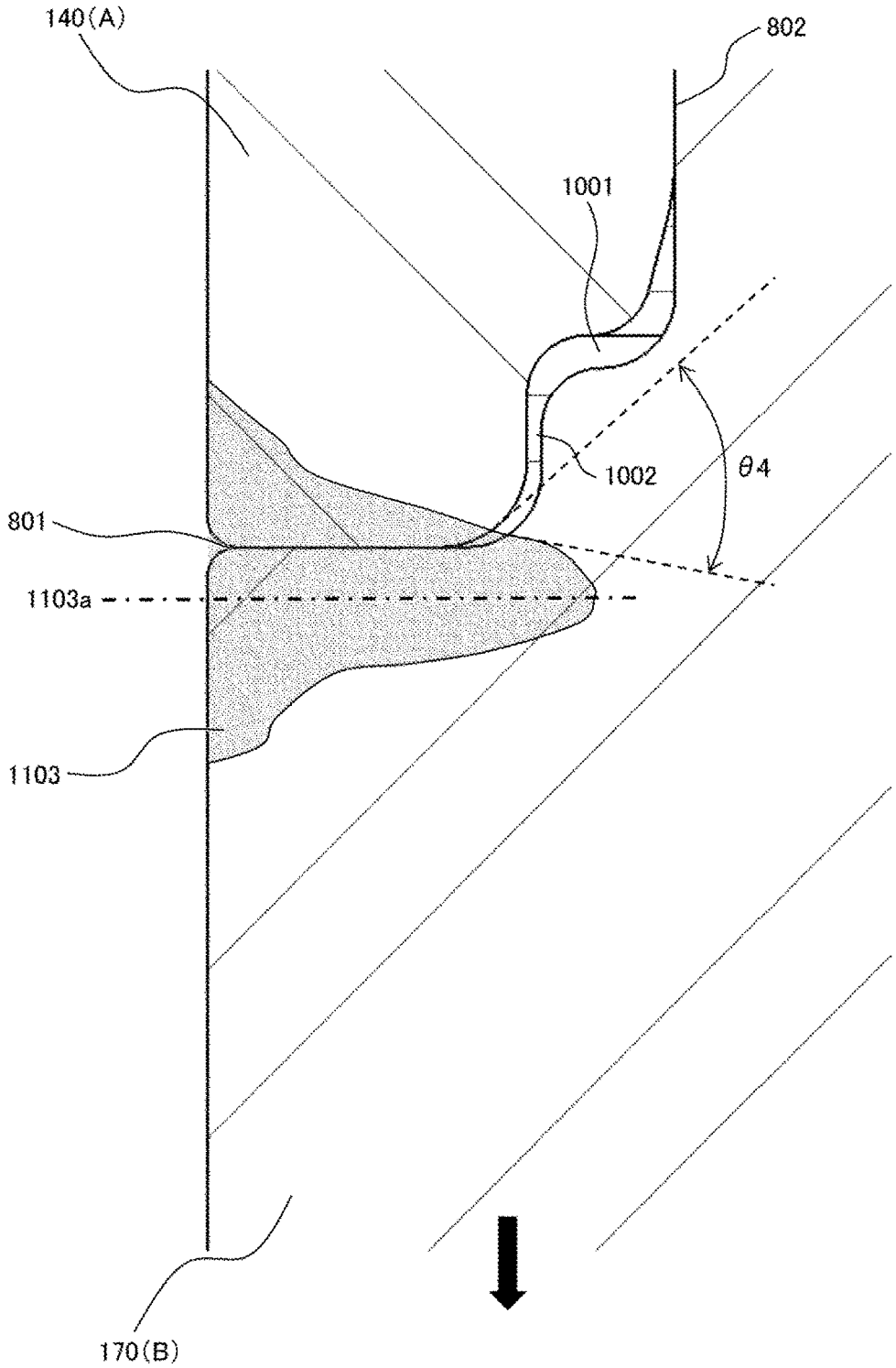
FIG. 11 is an enlarged cross-sectional view of a welded portion between an adapter 140 and a fixed core 107 according to Comparative Example 7 of the present invention.

A case where the welding center position 803*a* deviates from a target position toward the second component B in the drawing will be described with reference to FIG. 11. FIG. 11 is an enlarged cross-sectional view of a welded portion between an adapter 140 and a fixed core 107 according to Comparative Example 7 of the present invention.

In Comparative Example 7, an angle θ4 formed by a butt-welded portion 1103, which is melted and re-solidified metal after welding, and a first component A is small. Therefore, stress generated in the welded portion 1103 becomes large, and strength of the welded portion 1103 is reduced. As above, a weld penetration center 1103*a* needs to be located closer to the first component A than an abutting surface 801.

The description will be given with reference to FIG. 10 again. An angle is θ3, the angle formed by a tangent line 1004 in contact with a surface 803*b* of the butt-welded portion 803 and a tangent line 1005 drawn on the second inner peripheral surface 301C at a position 1003 where the surface 803*b* of the butt-welded portion 803, which is melted and re-solidified metal, intersect a first member A, that is, at the position 1003 of an end portion having the weld joint length L2 on the surface 803*b* of the butt-welded portion 803, alternatively, at an intersection 1003 between the surface 803*b* of the butt-welded portion 803 and the second inner peripheral surface 301C forming the second gap 1002.

Figure 12:
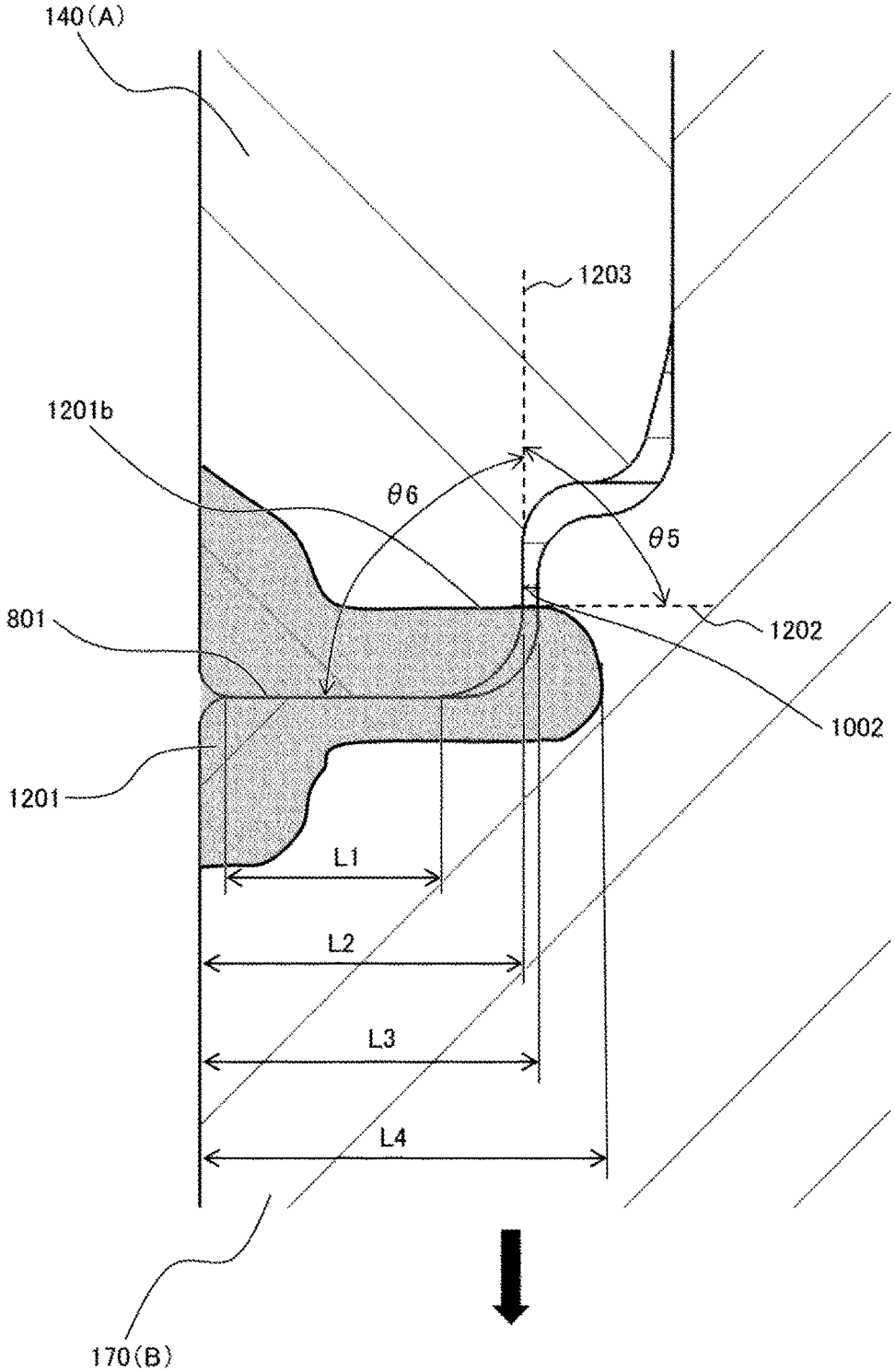
FIG. 12 is an enlarged cross-sectional view of a welded portion between the adapter 140 and the fixed core 107 according to a modification of the present invention.

Since the angle θ3 of the present embodiment is larger than the angle θ2 of Comparative Example 6 illustrated in FIG. 7, the increase in stress due to the stress concentration is reduced, and the strength of the welded portion 803 can be maintained. Note that it is possible to maintain desired fixing strength in the fuel injection valve 1 if the angle θ3 is, for example, 90 degrees or larger, and the angle θ3 is larger than 90 degrees. A modification of the present embodiment will be described with reference to FIG. 12. FIG. 12 is an enlarged cross-sectional view of a welded portion between the adapter 140 and the fixed core 107 according to the modification of the present invention.

It is preferable that an angle θ6 formed by a tangent line 1203 and the abutting surface 801 be small in order to maximize an angle θ5 formed between a tangent line 1202 of an upper surface portion 1201*b* of the butt-welded portion 803 and the second inner peripheral surface 301C forming the second gap 1002 or the tangent line 1203 of the second inner peripheral surface 301C. However, the second gap 1002 needs to be small in order to prevent lubricant from entering a welded portion 1201, and it is necessary for the first component A and the second component B not to interfere with each other to press-fit both the components, and thus, θ5 and θ6 are set to about 90 degrees.

Figure 13:
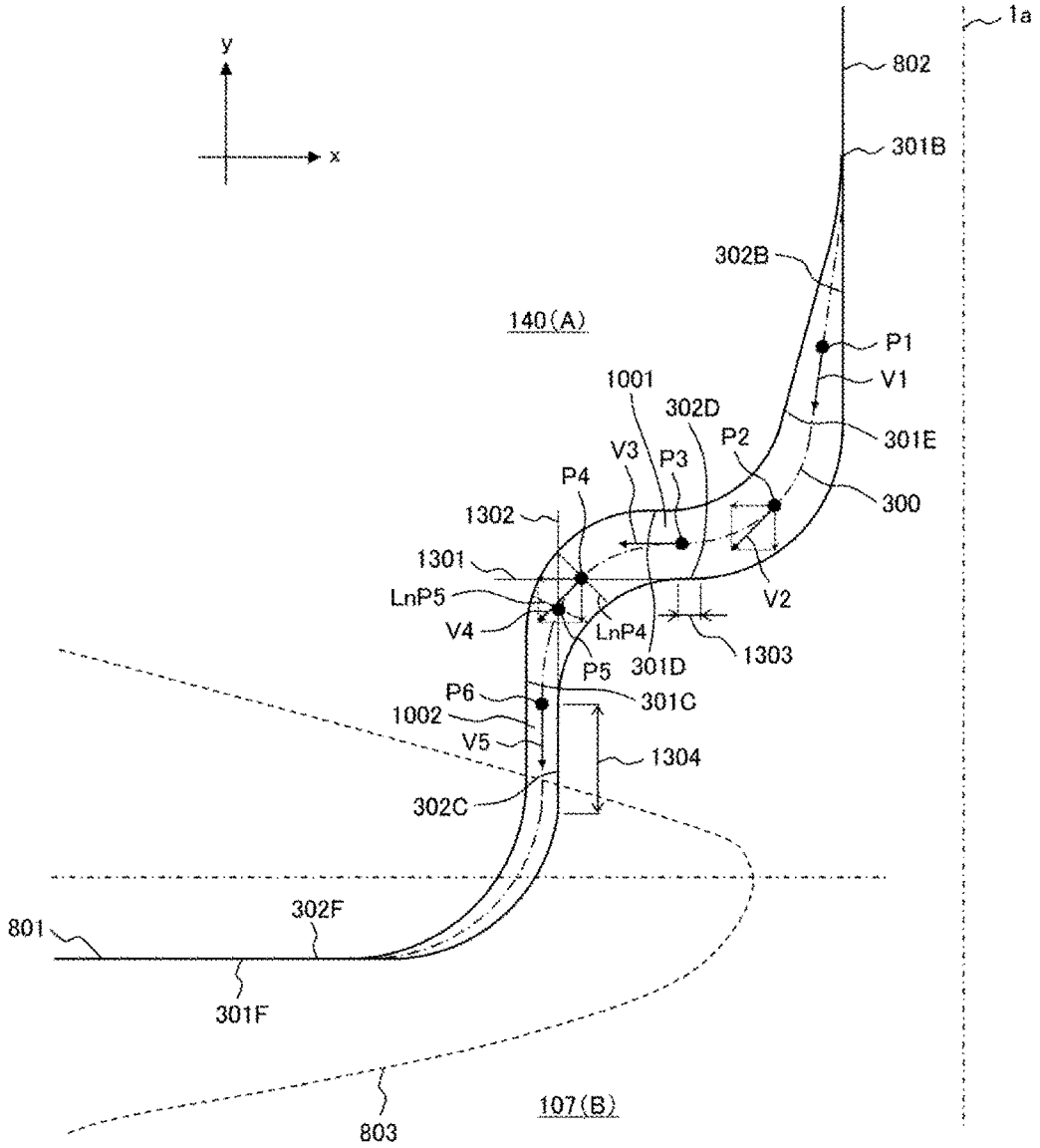
FIG. 13 is a conceptual view illustrating a configuration of a first gap 1001 and a second gap 1002.

The first gap 1001 and the second gap 1002 will be described with reference to FIG. 13. FIG. 13 is a conceptual view illustrating a configuration of the first gap 1001 and the second gap 1002. Note that FIG. 13 is a plan view that includes the central axis 1*a* and is parallel to the central axis 1*a*.

In FIG. 13, a y-axis and an x-axis are defined as described in the drawing. The y-axis is on the same plane as the central axis 1*a* and is parallel to the central axis 1*a*. The x-axis is on the same plane as the y-axis and the central axis 1*a*, and is parallel to the radial direction.

In the present embodiment, a straight portion is formed in each of the step surface 301D and the step surface 302D forming the first gap 1001 in FIG. 13. In this case, a straight line segment 1301 extended from a straight portion 1303 of the step surface 302D serves as a boundary that divides the first gap 1001 and the second gap 1002. That is, the first gap 1001 extends from the straight line segment 1301 toward the press-fitting portion 802, and the second gap 1002 is located on the side of the abutting portion (abutting surface) 801 or the butt-welded portion 803 with respect to the straight line segment 1301.

If the straight portion 1303 of the step surface 302D is not identifiable, the boundary between the first gap 1001 and the second gap 1002 may be identified based on a center line 300 passing through centers of the first gap 1001 and the second gap 1002. The center line 300 is a line segment, which connects points where the distance from the adapter 140 and the distance from the fixed core 107 are equal, on a straight line segment connecting the adapter 140, which is the first component A, and the fixed core 107, which is the second component B, with the shortest distance in FIG. 13, and is a bent line segment as illustrated in FIG. 13. In the present embodiment, there are two bent portions in the first gap 1001 and the second gap 1002. Note that the second gap 1002 inside the butt-welded portion 803 is filled with the molten metal and does not exist as a gap. At points P1 to P6 on the center line 300, unit vectors V1 to V6 in contact with the center line 300 are set. At each of the points P1 to P6, each magnitude of an x-axis component and a y-axis component of the unit vectors V1 to V6 changes. At the point P3, the y-axis component becomes zero and the magnitude of the x-axis component becomes one. That is, it can be understood that a radial gap is formed at the point P3. That is, it can be understood that a radial gap is formed at the point P3. On the other hand, the x-axis component becomes zero and the magnitude of the y-axis component becomes one at the point P6. That is, it can be understood that a gap is formed in the direction of the central axis 1*a* at the point P6. At the points P2 and P4, the magnitude of the x-axis component and the magnitude of the y-axis component become equal. In this case, the boundary between the first gap 1001 and the second gap 1002 may be identified using P4, as a reference, at which the radial gap changes to the gap formed in the direction of the central axis 1*a*. That is, a straight line segment LnP4 passing through P4 and connecting the adapter 140 and the fixed core 107 with the shortest distance is set as the boundary. The first gap 1001 extends from the straight line segment LnP4 toward the press-fitting portion 802, and the second gap 1002 is located on the side of the abutting portion (abutting surface) 801 or the butt-welded portion 803 with respect to the straight line segment LnP4.

Alternatively, a straight portion is formed on each of the second inner peripheral surface 301C and the second outer peripheral surface 302C forming the second gap 1002 in the present embodiment. If the straight portion 1303 of the step surface 302D is not identifiable, the boundary between the first gap 1001 and the second gap 1002 may be identified based on a straight portion 1304 of the second outer peripheral surface 302C. In this case, in FIG. 13, an intersection P5 between a straight line segment 1302 extended from the straight portion 1304 and the center line 300 is determined, and a straight line segment LnP5, which passes through the intersection P5 and connects the adapter 140 and the fixed core 107 with the shortest distance, is defined as the boundary that divides the first gap 1001 and the second gap 1002. The first gap 1001 extends from the straight line segment LnP5 toward the press-fitting portion 802, and the second gap 1002 is located on the side of the abutting portion (abutting surface) 801 or the butt-welded portion 803 with respect to the straight line segment LnP5.

As described above, the component of the present embodiment includes: the first component 140 (A); the second component 107 (B) fixed to the first component 140 (A) by the press-fitting portion 802; the welded portion 803 that connects the first component 140 (A) and the second component 107 (B); and the first gap 1001 and the second gap 1002 formed between the mutually opposing surfaces of the first component 140 (A) and the second component 107 (B). The first gap 1001 is provided between the press-fitting portion 802 and the welded portion 803 on the press-fitting portion 802 side with respect to the second gap 1002, and is formed in the direction intersecting the press-fitting direction. The second gap 1002 is provided between the press-fitting portion 802 and the welded portion 803 on the welded portion 803 side with respect to the first gap 1001, and is formed in the direction intersecting the first gap 1001.

The welded portion 803 is the butt-welded portion having the butt-joint configuration, the first gap 1001 is connected to the press-fitting portion 802, and the second gap 1002 is connected to the butt-welded portion 803.

The first component 140 (A) includes a first-component-side stepped portion having the large-diameter inner peripheral surface 301C and the small-diameter inner peripheral surface 301B on the inner peripheral side. The second component 107 (B) includes a second-component-side stepped portion having the large-diameter outer peripheral surface 107E, the medium-diameter outer peripheral surface 302C, and the small-diameter outer peripheral surface 302B on the outer peripheral side. The press-fitting portion 802 is formed between the small-diameter inner peripheral surface 301B of the first component 140 (A) and the small-diameter outer peripheral surface 302B of the second component 107 (B). The butt-welded portion 803 is formed between the first component end surface 301F, formed between the outer peripheral surface 140A and the large-diameter inner peripheral surface 301C of the first component 140 (A), and the second component first step surface 302F formed between the large-diameter outer peripheral surface 107E and the medium-diameter outer peripheral surface 302C of the second component 107 (B).

The first gap 1001 is formed between the first component step surface 301D, formed between the large-diameter inner peripheral surface 301C and the small-diameter inner peripheral surface 301B of the first component 140 (A), and the second component second step surface 302D formed between the medium-diameter outer peripheral surface 302C and the small-diameter outer peripheral surface 302B of the second component 107 (B). The second gap 1002 is formed between the large-diameter inner peripheral surface 301C of the first component 140 (A) and the medium-diameter outer peripheral surface 302C of the second component 107 (B).

The minimum interval L5 of the first gap 1001 in the press-fitting direction (direction of the central axis 1*a*) is configured to be larger than the minimum interval L6 of the second gap 1002 in the direction (radial direction) intersecting the press-fitting direction. The volume of the first gap 1001 is configured to be larger than the volume of the second gap 1002. The deepest portion L4 in the welding depth direction of the butt-welded portion is configured to be located on the side where the welding depth becomes deeper with respect to the second gap 1002.

The first gap 1001 is configured to have the elongated shape such that the length in the direction (radial direction) intersecting the press-fitting direction is longer than the interval L5 formed between the mutually opposing surfaces of the first component 140 (A) and the second component 107 (B). The second gap 1002 is configured to have the elongated shape such that the length in the press-fitting direction (direction of the central axis 1*a*) is longer than the interval formed between the mutually opposing surfaces of the first component 140 (A) and the second component 107 (B).

The fuel injection valve of the present embodiment includes: the fixed core 107; the movable core 102 and the valve body 114A driven by the magnetic attraction force of the fixed core 107; the fuel injection hole 117 for injecting fuel when the valve body 114A is separated from the valve seat 39; and the adapter 140 connected to the fixed core 107 to form the fuel supply port 118. The fixed core 107 is configured using the second component A, and the adapter 140 is configured using the first component A.

The weld shape of the present embodiment illustrated in FIG. 10 has an advantage that the first component A and the second component B are not required to have complicated shapes and the manufacturing cost of the components is not increased. Further, it is unnecessary to change a position and an angle of the penetration center 803*a* during laser welding, there is an advantage that cost of welding equipment is not increased. Further, the welding time can be shortened since the position and angle of the penetration center 803*a* are not changed during laser welding.

As above, according to the embodiment of the present invention, it is possible to suppress the generation of blowholes at the time of welding in the site where the lubricant is used for press fitting, and to minimize the amount of penetration of the butt-welded portion. Further, the welding time and the cost of welding equipment can be reduced in the present embodiment. Furthermore, it is possible to realize the butt welding configuration capable of suppressing the excessive stress concentration with respect to the load in the present embodiment.

Note that the present invention is not limited to the above-described embodiment, but includes various modifications.

For example, the above-described embodiment has been described in detail in order to describe the present invention in an easily understandable manner, and are not necessarily limited to one including the entire configuration that has been described above. Further, a part of the configuration of the embodiment can be deleted or replaced with another configuration, and another configuration can be added to the configuration of the embodiment.

REFERENCE SIGNS LIST

39 valve seat
102 movable core
107 fixed core
107E large-diameter outer peripheral surface
114A valve body
117 fuel injection hole
118 fuel supply port
140 adapter
301B small-diameter inner peripheral surface
301C large-diameter inner peripheral surface
301B, 301C first-component-side stepped portion
301D first component step surface
301F first component end surface
302B small-diameter outer peripheral surface
302C medium-diameter outer peripheral surface
302D second component second step surface
302B, 302C, 302E second-component-side stepped portion
302F second component first step surface
802 press-fitting portion
803 butt-welded portion
1001 first gap
1002 second gap
A first component
B second component

The invention claimed is:

1. A component for a flow rate control device comprising:
a first component;
a second component fixed to the first component by a press-fitting portion;
a welded portion that connects the first component and the second component; and
a first gap and a second gap formed between mutually opposing surfaces of the first component and the second component,
wherein the first gap is provided on a side of the press-fitting portion with respect to the second gap between the press-fitting portion and the welded portion, and is formed in a direction intersecting a press-fitting direction, and
the second gap is provided on a side of the welded portion with respect to the first gap between the press fitting portion and the welded portion, and is formed in a direction intersecting the first gap,
wherein the welded portion is a butt-welded portion having a butt-joint configuration, and the first gap is connected to the press-fitting portion, and the second gap is connected to the butt-welded portion,
wherein a volume of the first gap is configured to be larger than a volume of the second gap,
wherein the first gap extends in a radial direction, and the second gap extends in a vertical direction perpendicular to the radial direction.

2. The component for a flow rate control device according to claim 1, wherein
the first component includes a first-component-side stepped portion having a large-diameter inner peripheral surface and a small-diameter inner peripheral surface on an inner peripheral side,
the second component includes a second-component-side stepped portion having a large-diameter outer peripheral surface, a medium-diameter outer peripheral surface, and a small-diameter outer peripheral surface on an outer peripheral side,
the press-fitting portion is formed between the small-diameter inner peripheral surface of the first component and the small-diameter outer peripheral surface of the second component, and
the butt-welded portion is formed between a first component end surface, formed between an outer peripheral surface and the large-diameter inner peripheral surface of the first component, and a second component first step surface formed between the large-diameter outer peripheral surface and the medium-diameter outer peripheral surface of the second component.

3. The component for a flow rate control device according to claim 2, wherein
the first gap is formed between a first component step surface, formed between the large-diameter inner peripheral surface and the small-diameter inner peripheral surface of the first component, and a second component second step surface formed between the medium-diameter outer peripheral surface and the small-diameter outer peripheral surface of the second component, and
the second gap is formed between the large-diameter inner peripheral surface of the first component and the medium-diameter outer peripheral surface of the second component.

4. The component for a flow rate control device according to claim 1, wherein a minimum interval of the first gap in the press-fitting direction is configured to be larger than a minimum interval of the second gap in the direction intersecting the press-fitting direction.

5. The component for a flow rate control device according to claim 1, wherein a deepest portion in a welding depth direction of the butt-welded portion is configured to be located on a side where a welding depth becomes deeper with respect to the second gap.

6. The component for a flow rate control device according to claim 1, wherein the first gap is configured to have an elongated shape such that a length in the direction intersecting the press-fitting direction is longer than an interval formed between the mutually opposing surfaces of the first component and the second component.

7. The component for a flow rate control device according to claim 1, wherein the second gap is configured to have an elongated shape such that a length in the press-fitting direction is longer than an interval formed between the mutually opposing surfaces of the first component and the second component.

8. A fuel injection valve comprising:

a fixed core;

a movable core and a valve body driven by a magnetic attraction force of the fixed core;

a fuel injection hole for injecting fuel when the valve body is separated from a valve seat; and an adapter connected to the fixed core to form a fuel supply port, wherein the fixed core and the adapter are configured using the component for a flow rate control device according to claim 1 such that the fixed core is provided as the second component and the adapter is provided as the first component.

9. The component for a flow rate control device according to claim 1, wherein an angle formed by a first tangent line tangent with an upper surface of the butt-welded portion, and a second tangent line tangent to the vertical direction, is 90 degrees or larger.

* * * * *